US010373423B2

(12) United States Patent
Humphrey et al.

(10) Patent No.: US 10,373,423 B2
(45) **Date of Patent: *Aug. 6, 2019**

(54) GAMING SYSTEM AND METHOD PROVIDING A MULTIPLAYER SECONDARY GAME HAVING AN OUTCOME DETERMINED BASED ON PLAY OF A PRIMARY GAME OF AT LEAST ONE, BUT NOT ALL, OF THE MULTIPLAYER SECONDARY GAME PLAYERS

(71) Applicant: IGT, Las Vegas, NV (US)

(72) Inventors: Thomas J. Humphrey, Reno, NV (US); Thomas W. Allen, II, Reno, NV (US); Dylan B. Selegue, Reno, NV (US); Ross D. Wenker, Sparks, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/117,970

(22) Filed: Aug. 30, 2018

(65) Prior Publication Data

US 2018/0374300 A1 Dec. 27, 2018

Related U.S. Application Data

(63) Continuation of application No. 14/247,904, filed on Apr. 8, 2014, now Pat. No. 10,068,415.

(51) Int. Cl.
*G07F 17/32* (2006.01)
*G07F 17/34* (2006.01)

(52) U.S. Cl.
CPC ..... *G07F 17/3225* (2013.01); *G07F 17/3211* (2013.01); *G07F 17/3258* (2013.01); *G07F 17/3272* (2013.01); *G07F 17/34* (2013.01)

(58) Field of Classification Search
CPC .. G07F 17/32; G07F 17/3225; G07F 17/3272; G07F 17/3283
USPC ..... 463/16–20
See application file for complete search history.

(56) References Cited

U.S. PATENT DOCUMENTS

| | | | |
|---|---|---|---|
| 4,695,053 | A | 9/1987 | Vazquez et al. |
| 4,775,155 | A | 10/1988 | Lees |
| 4,805,907 | A | 2/1989 | Hagiwara |
| 4,856,787 | A | 8/1989 | Itkis |
| 4,871,171 | A | 8/1989 | Itkis et al. |
| 4,874,164 | A | 10/1989 | Rivero |
| 5,083,271 | A | 1/1992 | Miner |

(Continued)

*Primary Examiner* — Michael A Cuff
(74) *Attorney, Agent, or Firm* — Neal, Gerber & Eisenberg LLP

(57) ABSTRACT

Various embodiments of the present disclosure provide a gaming system and method providing a multiplayer secondary game having an outcome determined based on play of a primary game of at least one, but not all, of the secondary game players. In various embodiments, play of a primary game of a designated one of a plurality of players of a secondary game controls play of the secondary game independent of any play of any primary games of the other players of the secondary game. Put differently, play of the secondary game depends on play of the primary game of the designated player and does not depend on any play of any primary games of the other. Thus, while multiple players participate in the secondary game and may concurrently play individual primary games, play of the primary game of one, but not all, of those players controls play of the secondary game.

20 Claims, 22 Drawing Sheets

(56) References Cited

U.S. PATENT DOCUMENTS 5,242,163 A 9/1993 Fulton
5,259,613 A 11/1993 Marnell, II
5,297,252 A 3/1994 Becker
5,356,140 A 10/1994 Dabrowski et al.
5,393,057 A 2/1995 Marnell, II
5,408,600 A 4/1995 Garfinkel et al.
5,411,271 A 5/1995 Mirando
5,471,577 A 11/1995 Lighbody et al.
5,536,016 A 7/1996 Thompson
5,609,337 A 3/1997 Clapper, Jr.
5,611,730 A 3/1997 Weiss
5,630,753 A 5/1997 Fuchs
5,639,089 A 6/1997 Matsumoto et al.
5,645,486 A 7/1997 Nagao et al.
5,647,798 A 7/1997 Falciglia
5,664,998 A 9/1997 Seelig et al.
5,741,183 A 4/1998 Acres et al.
5,755,619 A 5/1998 Matsumoto et al.
5,769,716 A 6/1998 Saffari et al.
5,779,544 A 7/1998 Seelig et al.
5,779,549 A 7/1998 Walker et al.
5,788,573 A 8/1998 Baerlocher et al.
5,790,818 A 8/1998 Martin
5,791,992 A 8/1998 Baerlocher et al.
5,820,460 A 10/1998 Fulton
5,823,874 A 10/1998 Adams
5,829,749 A 11/1998 Hobert
5,833,536 A 11/1998 Davids et al.
5,833,537 A 11/1998 Hobert et al.
5,848,932 A 11/1998 Davids et al.
5,851,148 A 11/1998 Barrie
5,882,261 A 3/1999 Adams et al.
5,923,379 A 3/1999 Adams et al.
5,890,962 A 4/1999 Takemoto
5,927,714 A 4/1999 Takemoto et al.
5,935,002 A 7/1999 Patterson
5,947,820 A 7/1999 Kaplan
5,951,397 A 8/1999 Falciglia
5,957,775 A 9/1999 Morro et al.
5,980,384 A 9/1999 Dickinson
5,984,779 A 9/1999 Cherry
5,995,146 A 11/1999 Barrie
5,997,401 A 11/1999 Bridgeman et al.
6,001,016 A 11/1999 Rasmussen et al.
6,004,208 A 12/1999 Crawford
6,006,252 A 12/1999 Walker et al.
6,019,369 A 2/2000 Nakagawa et al.
6,059,658 A 2/2000 Nakagawa et al.
6,039,648 A 3/2000 Guinn et al.
6,089,976 A 3/2000 Guinn et al.
6,089,978 A 5/2000 Mangano et al.
6,089,981 A 7/2000 Schneider et al.
6,093,102 A 7/2000 Adams
6,120,377 A 7/2000 Brenner et al.
6,135,884 A 7/2000 Bennett et al.
6,142,872 A 9/2000 McGinnis et al.
6,159,095 A 10/2000 Hedrick et al.
6,186,894 B1 2/2001 Mayeroff
6,203,428 B1 2/2001 Mayeroff
6,203,427 B1 3/2001 Walker et al.
6,203,430 B1 3/2001 Walker et al.
6,217,448 B1 3/2001 Giobbi et al.
6,224,482 B1 3/2001 Walker et al.
6,224,483 B1 4/2001 Olsen
6,224,486 B1 5/2001 Bennett
6,231,442 B1 5/2001 Mayeroff
6,302,790 B1 5/2001 Walker et al.
6,315,660 B1 5/2001 Mayeroff
6,315,666 B1 10/2001 Brossard
6,322,445 B1 11/2001 DeMar et al.
6,338,678 B1 1/2002 Seelig et al.
6,354,941 B2 3/2002 Miller
6,358,144 B1 3/2002 Ladlic et al.
6,364,766 B1 3/2002 Miller et al.
6,368,216 B1 3/2002 Kadlic et al.
6,373,500 B1 4/2002 Anderson et al.
6,379,246 B1 4/2002 Hedrick et al.
6,398,664 B1 4/2002 Daniels
6,508,709 B1 1/2003 Karmarkar
6,605,047 B2 1/2003 Karmarkar
6,514,144 B2 2/2003 Riendeau et al.
6,652,378 B2 2/2003 Riendeau et al.
6,656,040 B1 12/2003 Brosnan et al.
6,769,982 B1 8/2004 Brosnan
6,805,629 B1 10/2004 Weiss
6,819,345 B1 11/2004 Jones et al.
6,860,810 B2 3/2005 Cannon
6,869,361 B2 3/2005 Sharpless et al.
6,928,413 B1 8/2005 Pulitzer
6,942,574 B1 9/2005 LeMay et al.
7,070,505 B2 7/2006 Vancura et al.
7,081,050 B2 7/2006 Tarantino
7,125,333 B2 10/2006 Brosnan
7,169,041 B2 1/2007 Tessmer et al.
7,238,109 B2 7/2007 McGahn et al.
7,311,598 B2 12/2007 Kaminkow et al.
7,311,604 B2 12/2007 Kaminkow et al.
7,393,280 B2 7/2008 Cannon
7,427,236 B2 9/2008 Kaminkow et al.
7,500,915 B2 3/2009 Wolf et al.
7,597,621 B2 10/2009 Baerlocher
7,607,976 B2 10/2009 Baerlocher et al.
7,607,977 B2 10/2009 Baerlocher et al.
7,621,809 B2 11/2009 Baerlocher et al.
7,651,392 B2 1/2010 Pennington et al.
7,666,081 B2 2/2010 Baerlocher et al.
7,674,180 B2 3/2010 Graham et al.
7,684,882 B2 3/2010 Baerlocher et al.
7,690,977 B2 4/2010 Cuddy et al.
7,753,782 B2 7/2010 Cuddy et al.
7,785,189 B2 8/2010 Brosnan et al.
7,789,755 B2 9/2010 Davis et al.
7,805,680 B2 9/2010 Meyers et al.
7,819,745 B2 10/2010 Cuddy et al.
7,828,649 B2 11/2010 Cuddy et al.
7,833,093 B2 11/2010 Michaelson et al.
7,837,554 B2 11/2010 Kaminkow et al.
7,854,654 B2 12/2010 Baerlocher et al.
7,857,696 B2 12/2010 Tarantino
7,857,699 B2 12/2010 Baerlocher
7,862,430 B2 1/2011 Baerlocher et al.
7,892,093 B2 2/2011 Kniesteadt et al.
7,918,736 B2 4/2011 Walker et al.
7,918,738 B2 4/2011 Paulsen
7,963,847 B2 6/2011 Baerlocher
8,021,230 B2 9/2011 Baerlocher et al.
8,033,912 B2 10/2011 Cannon
8,070,578 B2 12/2011 Michaelson et al.
8,070,582 B2 12/2011 Lutnick
8,070,587 B2 12/2011 Davis et al.
8,070,593 B2 12/2011 DeWaal et al.
8,079,903 B2 12/2011 Nicely et al.
8,087,999 B2 1/2012 Oberberger et al.
8,092,297 B2 1/2012 Decasa et al.
8,105,149 B2 1/2012 DeWaal
8,109,821 B2 2/2012 Kovacs et al.
8,118,662 B2 2/2012 Caputo et al.
8,118,666 B2 2/2012 Nicely et al.
8,128,491 B2 3/2012 Vasquez et al.
8,162,666 B2 4/2012 Parham
8,171,158 B1 5/2012 Grignetti
8,177,633 B2 5/2012 Baerlocher et al.
8,210,935 B2 7/2012 Caputo et al.
8,216,065 B2 7/2012 Kaminkow et al.
8,231,448 B2 7/2012 Cuddy et al.
8,251,791 B2 8/2012 Baerlocher et al.
8,292,723 B2 10/2012 DeWaal
8,371,938 B2 2/2013 Peterson
8,382,572 B2 2/2013 Hoffman et al.
8,393,968 B2 3/2013 Nicely et al.
8,491,381 B2 7/2013 Nicely et al.
8,491,392 B2 7/2013 Baerlocher
8,496,519 B2 7/2013 Hoffman et al.
8,500,548 B2 8/2013 Baerlocher et al.

(56) References Cited

U.S. PATENT DOCUMENTS

| | | | |
|---|---|---|---|
| 8,512,139 | B2 | 8/2013 | Williams et al. |
| 8,517,818 | B2 | 8/2013 | Nicely et al. |
| 8,602,865 | B2 | 12/2013 | Zielinski |
| 2001/0004609 | A1 | 6/2001 | Walker et al. |
| 2001/0034268 | A1 | 10/2001 | Thomas et al. |
| 2001/0049305 | A1 | 12/2001 | Riendeau et al. |
| 2002/0045472 | A1 | 4/2002 | Adams |
| 2002/0086725 | A1 | 7/2002 | Fasbender et al. |
| 2002/0151363 | A1 | 10/2002 | Letovsky et al. |
| 2003/0064772 | A1 | 4/2003 | Tempest et al. |
| 2003/0224852 | A1 | 12/2003 | Walker et al. |
| 2004/0072619 | A1 | 4/2004 | Brosnan et al. |
| 2004/0137978 | A1 | 7/2004 | Cole et al. |
| 2004/0204235 | A1 | 10/2004 | Walker et al. |
| 2005/0119052 | A1 | 6/2005 | Russell et al. |
| 2005/0148378 | A1 | 7/2005 | Fasbender et al. |
| 2005/0239530 | A1 | 10/2005 | Walker et al. |
| 2006/0143085 | A1 | 6/2006 | Adams et al. |
| 2007/0054732 | A1 | 3/2007 | Baerlocher |
| 2007/0077981 | A1 | 4/2007 | Hungate et al. |
| 2007/0243925 | A1 | 10/2007 | LeMay et al. |
| 2007/0243928 | A1 | 10/2007 | Iddings |
| 2007/0243934 | A1 | 10/2007 | Little et al. |
| 2008/0009344 | A1 | 1/2008 | Graham et al. |
| 2008/0076542 | A1 | 3/2008 | Iddings et al. |
| 2008/0268958 | A1 | 10/2008 | Walker et al. |
| 2009/0042644 | A1 | 2/2009 | Zielinski |
| 2009/0104954 | A1 | 4/2009 | Weber et al. |
| 2009/0117970 | A1 | 5/2009 | De Waal et al. |
| 2009/0124327 | A1 | 5/2009 | Caputo et al. |
| 2009/0124362 | A1 | 5/2009 | Cuddy et al. |
| 2009/0189351 | A1 | 7/2009 | Baerlocher et al. |
| 2009/0233705 | A1 | 9/2009 | LeMay et al. |
| 2009/0325686 | A1 | 12/2009 | Davis |
| 2010/0056247 | A1 | 3/2010 | Nicely |
| 2010/0105454 | A1 | 4/2010 | Weber et al. |
| 2010/0120486 | A1 | 5/2010 | DeWaal et al. |
| 2010/0137056 | A1 | 6/2010 | Hoffman et al. |
| 2010/0317424 | A1 | 12/2010 | Hornik |
| 2011/0034237 | A1 | 2/2011 | Schulhof |
| 2011/0111827 | A1 | 5/2011 | Nicely et al. |
| 2011/0117990 | A1 | 5/2011 | Wilkins et al. |
| 2011/0143834 | A1 | 6/2011 | Guinn |
| 2011/0230251 | A1 | 9/2011 | Nicely et al. |
| 2012/0108319 | A1 | 5/2012 | Caputo et al. |
| 2013/0035157 | A1 | 2/2013 | Weber et al. |
| 2013/0079088 | A1 | 3/2013 | Lafky et al. |
| 2013/0079110 | A1 | 3/2013 | Nicely et al. |
| 2013/0079113 | A1 | 3/2013 | Nicely et al. |
| 2013/0079114 | A1 | 3/2013 | Nicely et al. |
| 2013/0079115 | A1 | 3/2013 | Nelson et al. |
| 2013/0079123 | A1 | 3/2013 | Nicely et al. |
| 2013/0084941 | A1 | 4/2013 | Caputo et al. |
| 2013/0084963 | A1 | 4/2013 | Shorrock et al. |
| 2013/0303265 | A1 | 11/2013 | Wilkins |
| 2014/0080563 | A1 | 3/2014 | Johnson |
| 2015/0221169 | A1 | 8/2015 | Filipour |

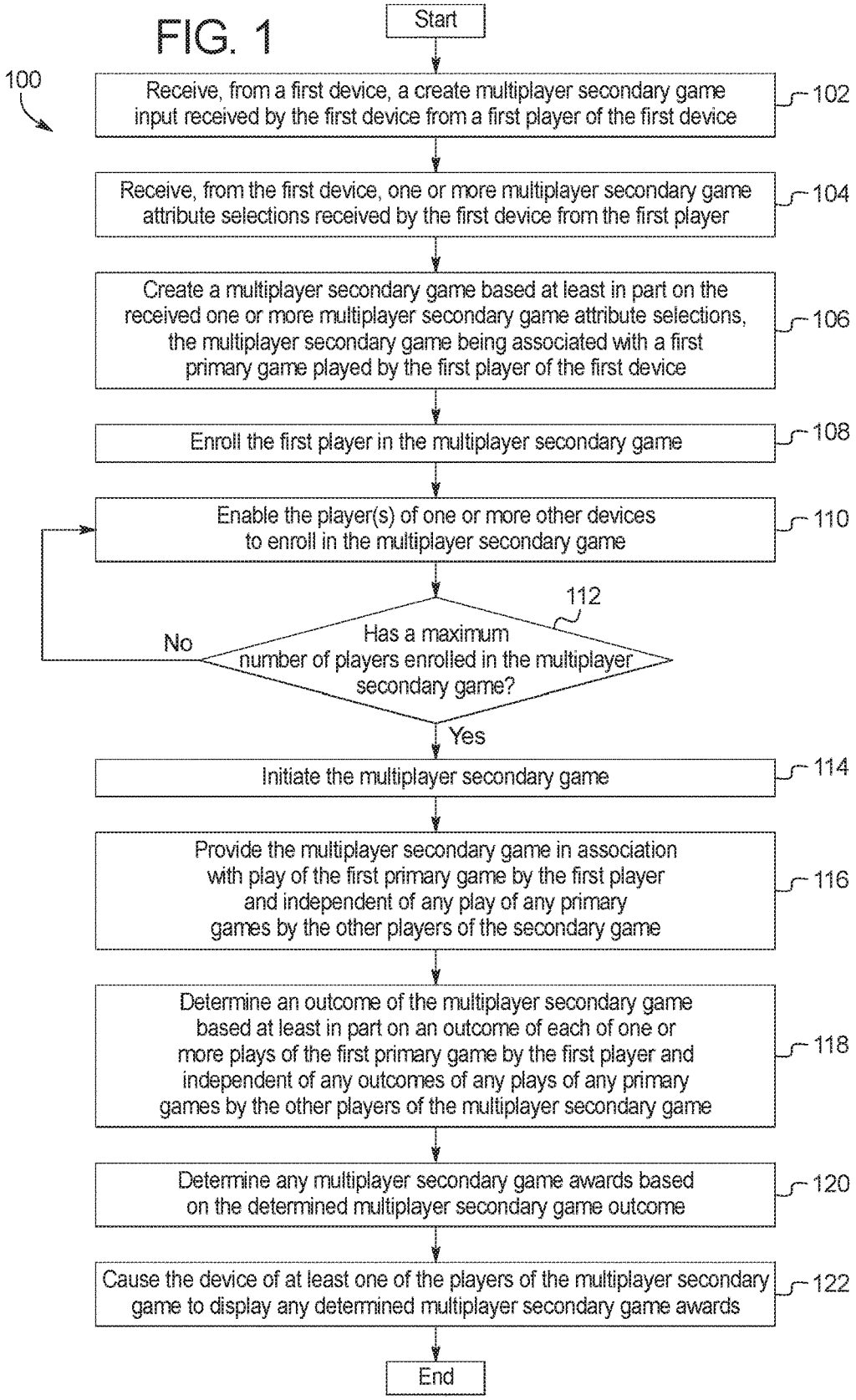
FIG. 1
Start
100
Receive, from a first device, a create multiplayer secondary game input received by the first device from a first player of the first device
102
Receive, from the first device, one or more multiplayer secondary game attribute selections received by the first device from the first player
104
Create a multiplayer secondary game based at least in part on the received one or more multiplayer secondary game attribute selections, the multiplayer secondary game being associated with a first primary game played by the first player of the first device
106
Enroll the first player in the multiplayer secondary game
108
Enable the player(s) of one or more other devices to enroll in the multiplayer secondary game
110
112
Has a maximum number of players enrolled in the multiplayer secondary game?
No
Yes
Initiate the multiplayer secondary game
114
Provide the multiplayer secondary game in association with play of the first primary game by the first player and independent of any play of any primary games by the other players of the secondary game
116
Determine an outcome of the multiplayer secondary game based at least in part on an outcome of each of one or more plays of the first primary game by the first player and independent of any outcomes of any plays of any primary games by the other players of the multiplayer secondary game
118
Determine any multiplayer secondary game awards based on the determined multiplayer secondary game outcome
120
Cause the device of at least one of the players of the multiplayer secondary game to display any determined multiplayer secondary game awards
122
End

GAMING SYSTEM AND METHOD PROVIDING A MULTIPLAYER SECONDARY GAME HAVING AN OUTCOME DETERMINED BASED ON PLAY OF A PRIMARY GAME OF AT LEAST ONE, BUT NOT ALL, OF THE MULTIPLAYER SECONDARY GAME PLAYERS

PRIORITY CLAIM

This application is a continuation of, claims priority to and the benefit of U.S. patent application Ser. No. 14/247,904, filed on Apr. 8, 2014, the entire contents of which is incorporated by reference herein.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

In recent years, gaming has become more of a social activity. Players often enjoy playing games in which the players compete against one another or work together toward a common goal. Accordingly, gaming establishments strive for ways to enable players to play games with other players either competitively or cooperatively to enhance the players' gaming experiences. A continuing need thus exists for gaming systems and methods that provide new, exciting, and engaging multiplayer or community games.

SUMMARY

Various embodiments of the present disclosure provide a gaming system and method providing a multiplayer secondary game having an outcome determined based on play of a primary game of at least one, but not all, of the multiplayer secondary game players. Generally, in various embodiments, play of a primary game of a designated one of a plurality of players of a multiplayer secondary game controls play of the multiplayer secondary game independent of any play of any primary games of the other players of the multiplayer secondary game. Put differently, in these embodiments, play of the multiplayer secondary game depends on play of the primary game of the designated player and does not depend on any play of any primary games of the other players of the multiplayer secondary game. Thus, while multiple players participate in the multiplayer secondary game and may play separate, individual primary games, in these embodiments, play of the primary game of one, but not all, of those players controls play of the multiplayer secondary game.

In one embodiment, the gaming system of the present disclosure includes a server and a plurality of devices (such as electronic gaming machines (EGMs) and/or personal gaming devices) that are configured to communicate with the server. In operation of this embodiment, the gaming system generally: (a) enables players of the devices to play individual primary games independent of one another; (b) enables each of the players to enroll in a multiplayer secondary game; and (c) when a designated number of players (such as a maximum number of players or at least a minimum number of players) has enrolled in the multiplayer secondary game, provides the multiplayer secondary game in association with play of the primary game played by a designated one of the players of the multiplayer secondary game and independent of any play of any primary games of the other players of the multiplayer secondary game.

In various embodiments, the gaming system enables players to create multiplayer secondary games, such as by selecting one or more attributes or characteristics of the multiplayer secondary game. In certain such embodiments, when providing a player-created multiplayer secondary game, the gaming system designates the player who created that multiplayer secondary game as the designated player whose primary game play controls play of the multiplayer secondary game. In other words, in these embodiments, when a player creates a multiplayer secondary game, the gaming system determines the outcome of the multiplayer secondary game based on play of the primary game of that particular player.

More specifically, in operation of one such embodiment, the server receives, from a first device, a create multiplayer secondary game input received by the first device from a first player of the first device. The server also receives, from the first device, one or more multiplayer secondary game attribute selections received by the first device from the first player. The server creates a multiplayer secondary game based at least in part on the received one or more multiplayer secondary game attribute selections. The multiplayer secondary game is associated with a first primary game played by the first player on the first device such that play of the first primary game by the first player controls play of the multiplayer secondary game independent of any play of any primary games of any other players of the multiplayer secondary game. In other words, in this embodiment, play of the multiplayer secondary game depends on one or more plays of the first primary game by the first player and does not depend on any plays of any primary games played by any other players of the multiplayer secondary game.

The server enrolls the first player in the multiplayer secondary game, and enables the players of the other devices to enroll in the multiplayer secondary game. Once a designated number of players (such as a maximum number of players or at least a minimum number of players) has enrolled in the multiplayer secondary game, the server initiates the multiplayer secondary game and provides the multiplayer secondary game in association with play of the first primary game by the first player and independent of any plays of any primary games by the other players of the multiplayer secondary game. The server determines an outcome of the multiplayer secondary game based at least in part on play of (such as an outcome of) each of one or more plays of the first primary game by the first player and independent of play of any primary games of the other players of the secondary game. The server determines any secondary game awards based on the determined secondary game outcome, and causes the device of at least one of the players of the secondary game to display any determined secondary game awards.

It should thus be appreciated that certain embodiments of the gaming system and method of the present disclosure provide new, exciting, and engaging multiplayer games.

Additional features and advantages are described herein, and will be apparent from, the following Detailed Description and the Figures.

BRIEF DESCRIPTION OF THE FIGURES

FIG. 1 illustrates a flowchart of an example process or method of operating one embodiment of the gaming system of the present disclosure.

FIGS. 2L, 2M, 2N, and 2O illustrate screen shots of the first EGM as the first player of the first EGM plays a primary keno game after the server initiates the created multiplayer secondary game.

DETAILED DESCRIPTION

Figure 2A:
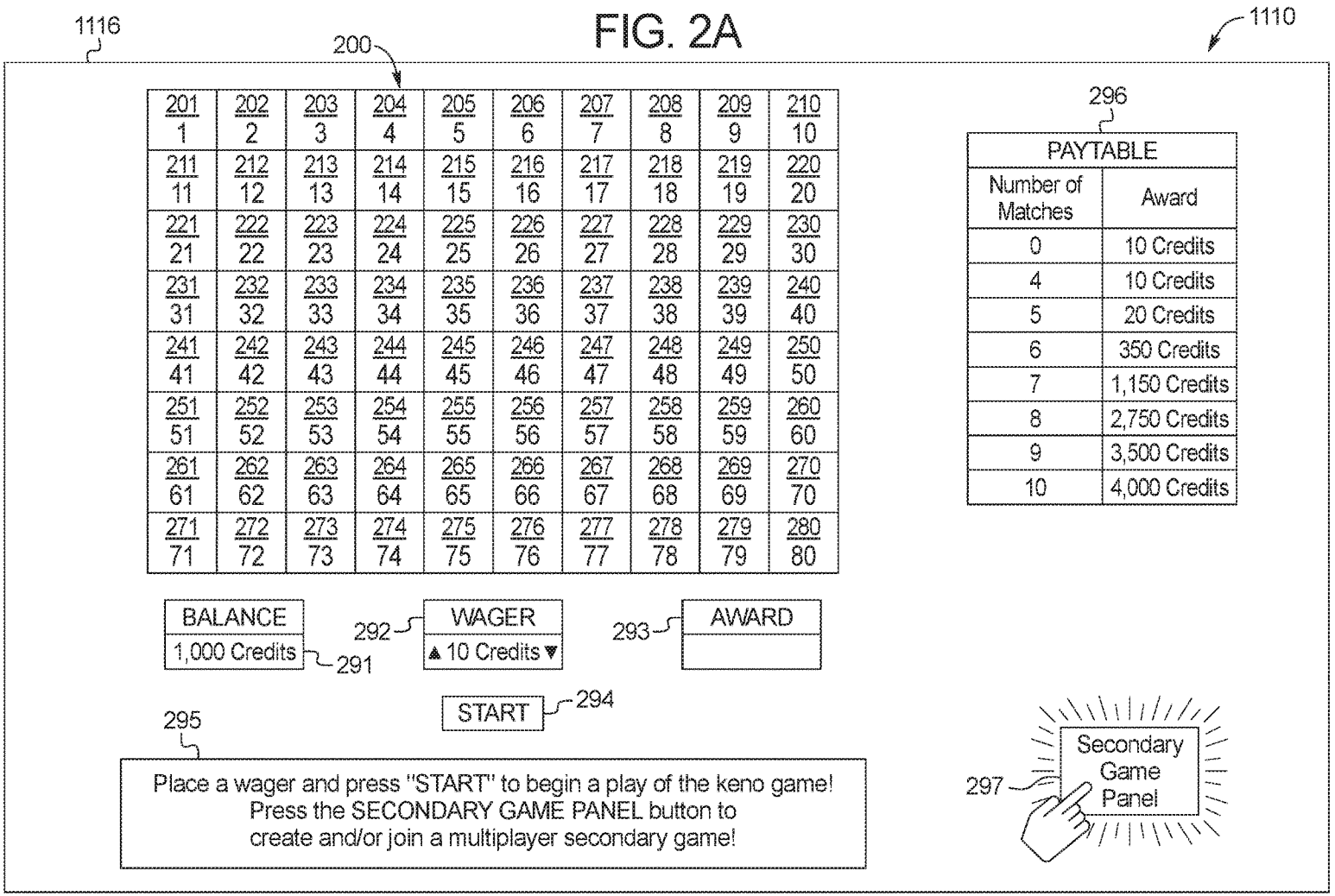
FIGS. 2A, 2B, 2C, 2D, and 2E illustrate screen shots of a first EGM as a first player of the first EGM creates and enrolls in a multiplayer secondary game.

Multiplayer Secondary Game Having an Outcome Determined Based on Play of a Primary Game of at Least One, But Not All, of the Multiplayer Secondary Game Players Various embodiments of the present disclosure provide a gaming system and method providing a multiplayer secondary game having an outcome determined based on play of a primary game of at least one, but not all, of the multiplayer secondary game players. Generally, in various embodiments, play of a primary game of a designated one of a plurality of players of a multiplayer secondary game controls play of the multiplayer secondary game independent of any play of any primary games of the other players of the multiplayer secondary game. Put differently, in these embodiments, play of the multiplayer secondary game depends on play of the primary game of the designated player and does not depend on any play of any primary games of the other players of the multiplayer secondary game. Thus, while multiple players participate in the multiplayer secondary game and may play separate, individual primary games, in these embodiments, play of the primary game of one, but not all, of those players controls play of the multiplayer secondary game.

In one embodiment, the gaming system of the present disclosure includes a server and a plurality of devices (such as electronic gaming machines (EGMs) and/or personal gaming devices) that are configured to communicate with the server. In operation of this embodiment, the gaming system generally: (a) enables players of the devices to play individual primary games independent of one another; (b) enables each of the players to enroll in a multiplayer secondary game; and (c) when a designated number of players (such as a maximum number of players or at least a minimum number of players) has enrolled in the multiplayer secondary game, provides the multiplayer secondary game in association with play of the primary game played by a designated one of the players of the multiplayer secondary game and independent of any play of any primary games of the other players of the multiplayer secondary game.

In various embodiments, the gaming system enables players to create multiplayer secondary games, such as by selecting one or more attributes or characteristics of the multiplayer secondary game. In certain such embodiments, when providing a player-created multiplayer secondary game, the gaming system designates the player who created that multiplayer secondary game as the designated player whose primary game play controls play of the multiplayer secondary game. In other words, in these embodiments, when a player creates a multiplayer secondary game, the gaming system determines the outcome of the multiplayer secondary game based on play of the primary game of that particular player.

FIG. 1 illustrates a flowchart of an example process or method 100 of operating one such embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the server receives, from a first device, a create multiplayer secondary game input received by the first device from a first player of the first device, as indicated by block 102. The server also receives, from the first device, one or more multiplayer secondary game attribute selections received by the first device from the first player, as indicated by block 104. The server creates a multiplayer secondary game based at least in part on the received one or more multiplayer secondary game attribute selections, as indicated by block 106. The multiplayer secondary game is associated with a first primary game played by the first player on the first device such that play of the first primary game by the first player controls play of the multiplayer secondary game independent of any play of any primary games of any other players of the multiplayer secondary game. In other words, in this example embodiment, play of the multiplayer secondary game depends on one or more plays of the first primary game by the first player and does not depend on any plays of any primary games played by any other players of the multiplayer secondary game.

The server enrolls the first player in the multiplayer secondary game, as indicated by block 108, and enables the players of the other devices to enroll in the multiplayer secondary game, as indicated by block 110. The server determines whether a maximum number of players has enrolled in the multiplayer secondary game, as indicated by diamond 112. If the server determines that the maximum number of players has not enrolled in the multiplayer secondary game, the process 100 returns to the block 110. If, on the other hand, the server determines that the maximum number of players has enrolled in the multiplayer secondary game, the server initiates the multiplayer secondary game, as indicated by block 114.

The server provides the multiplayer secondary game in association with play of the first primary game by the first player and independent of any plays of any primary games by the other players of the multiplayer secondary game, as indicated by block 116. The server determines an outcome of the multiplayer secondary game based at least in part on an outcome of each of one or more plays of the first primary game by the first player and independent of any outcomes of any plays of any primary games of the other players of the multiplayer secondary game, as indicated by block 118. The server determines any multiplayer secondary game awards based on the determined multiplayer secondary game outcome, as indicated by block 120, and causes the device of at least one of the players of the multiplayer secondary game to display any determined multiplayer secondary game awards, as indicated by block 122. The process 100 then ends.

Figure 2B:
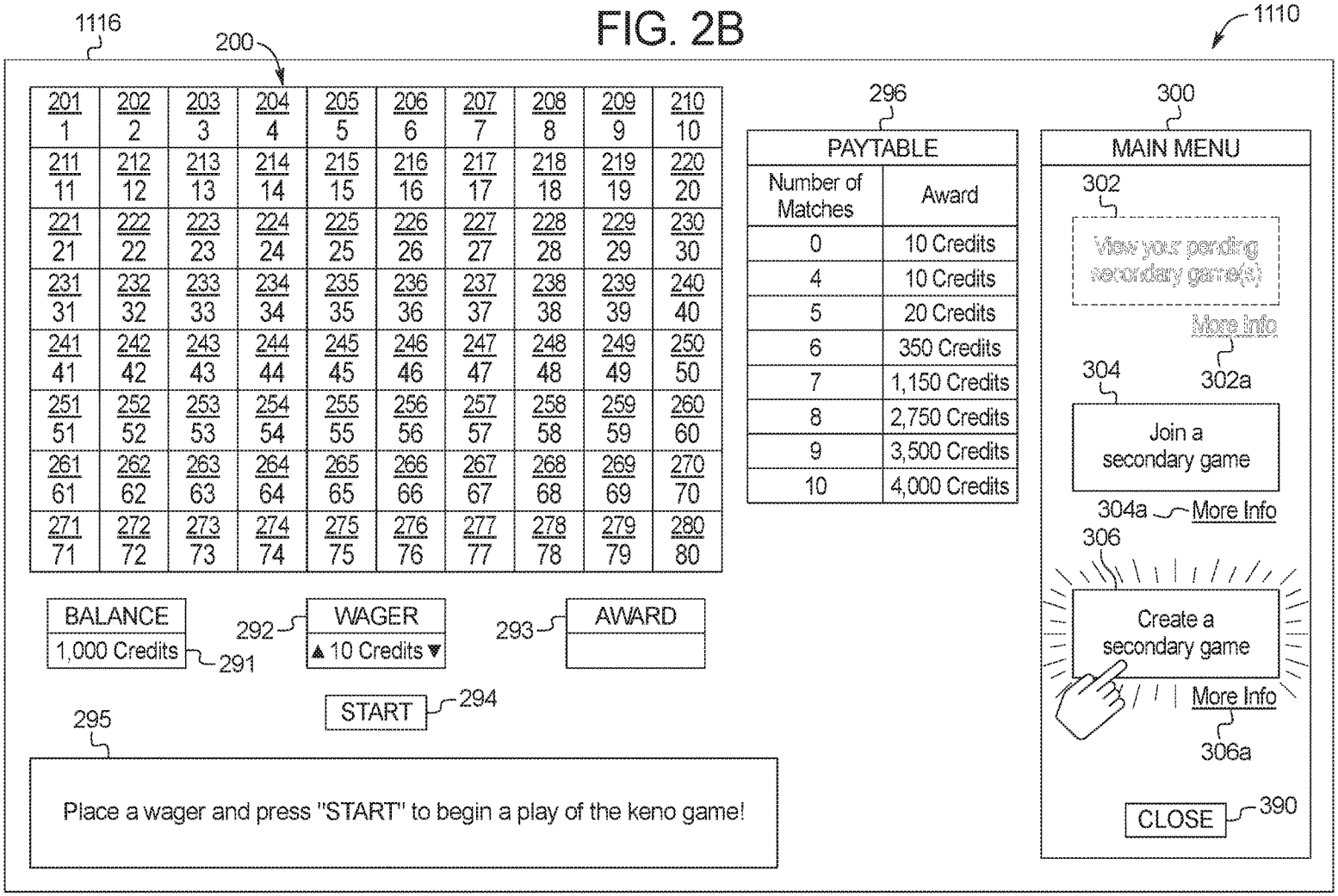
Figure 2C:
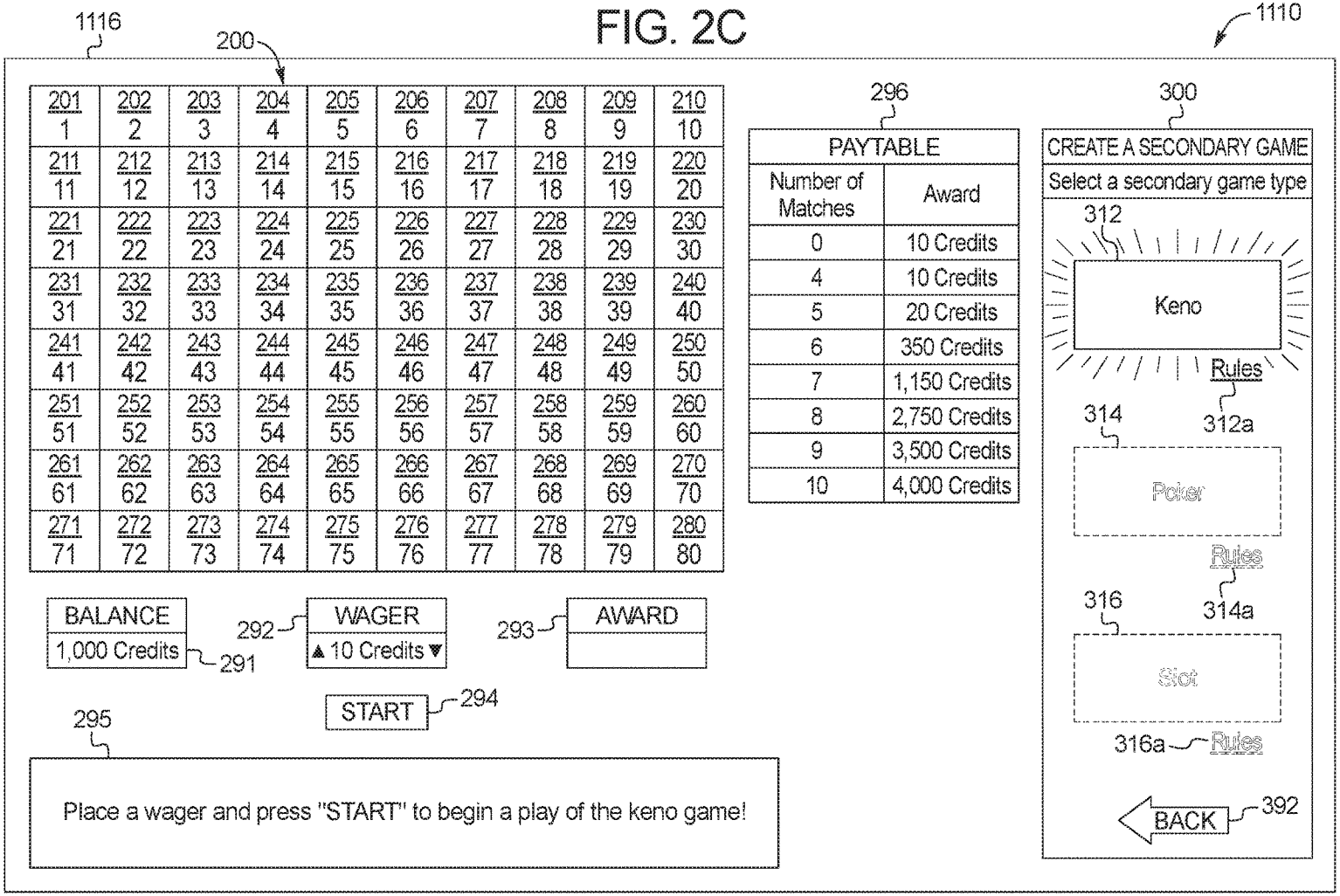
Figure 2D:
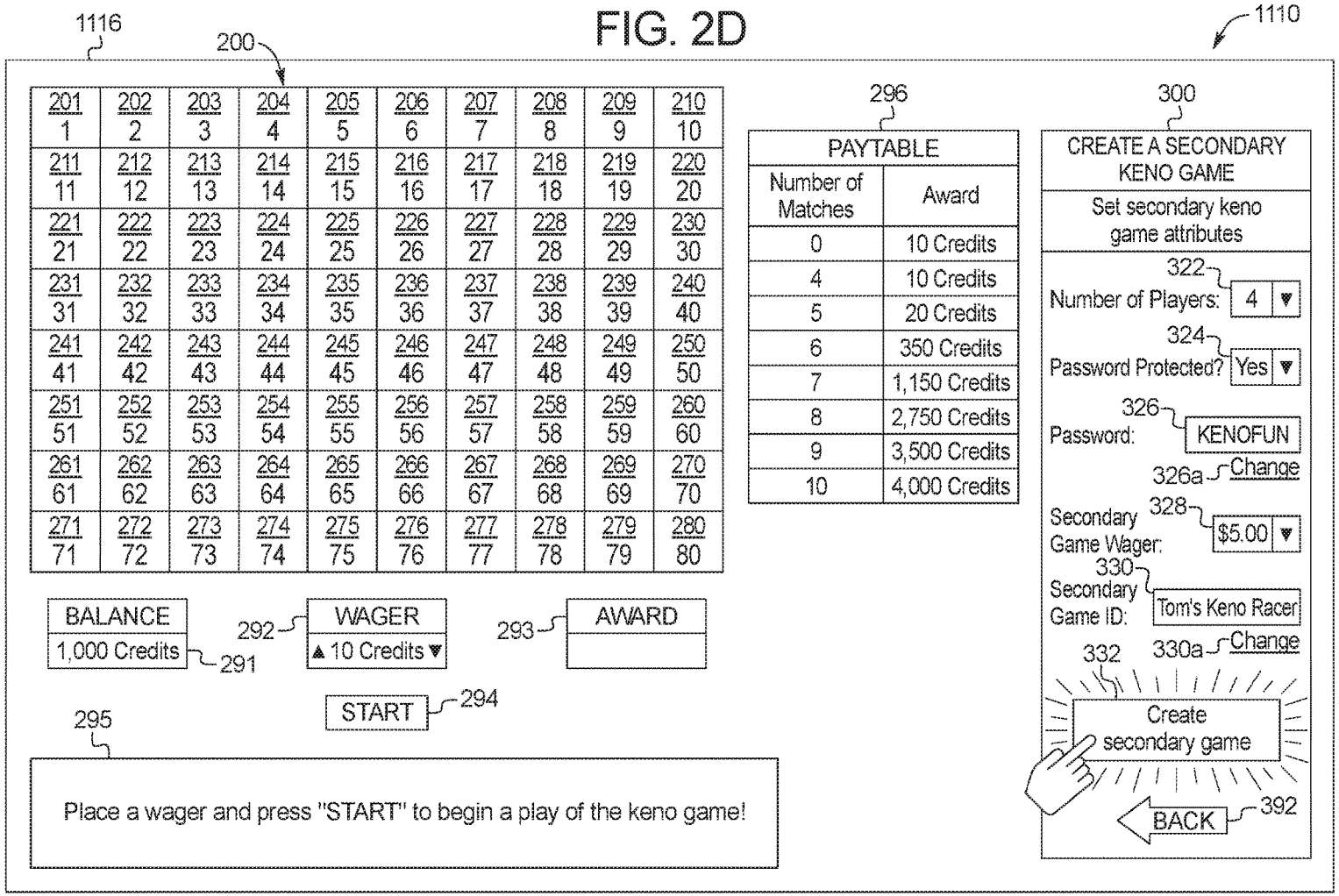
Figure 2E:
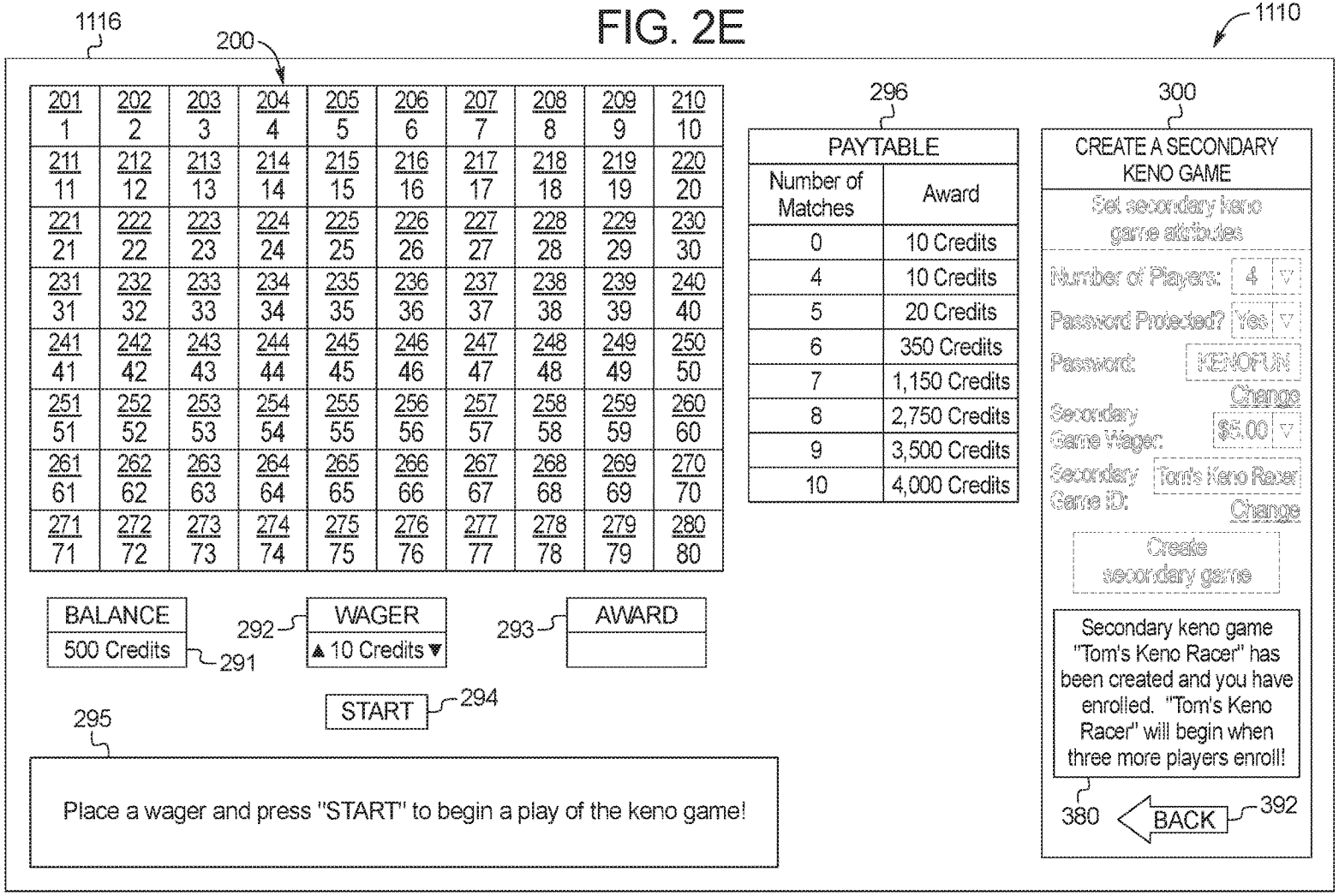
Figure 2F:
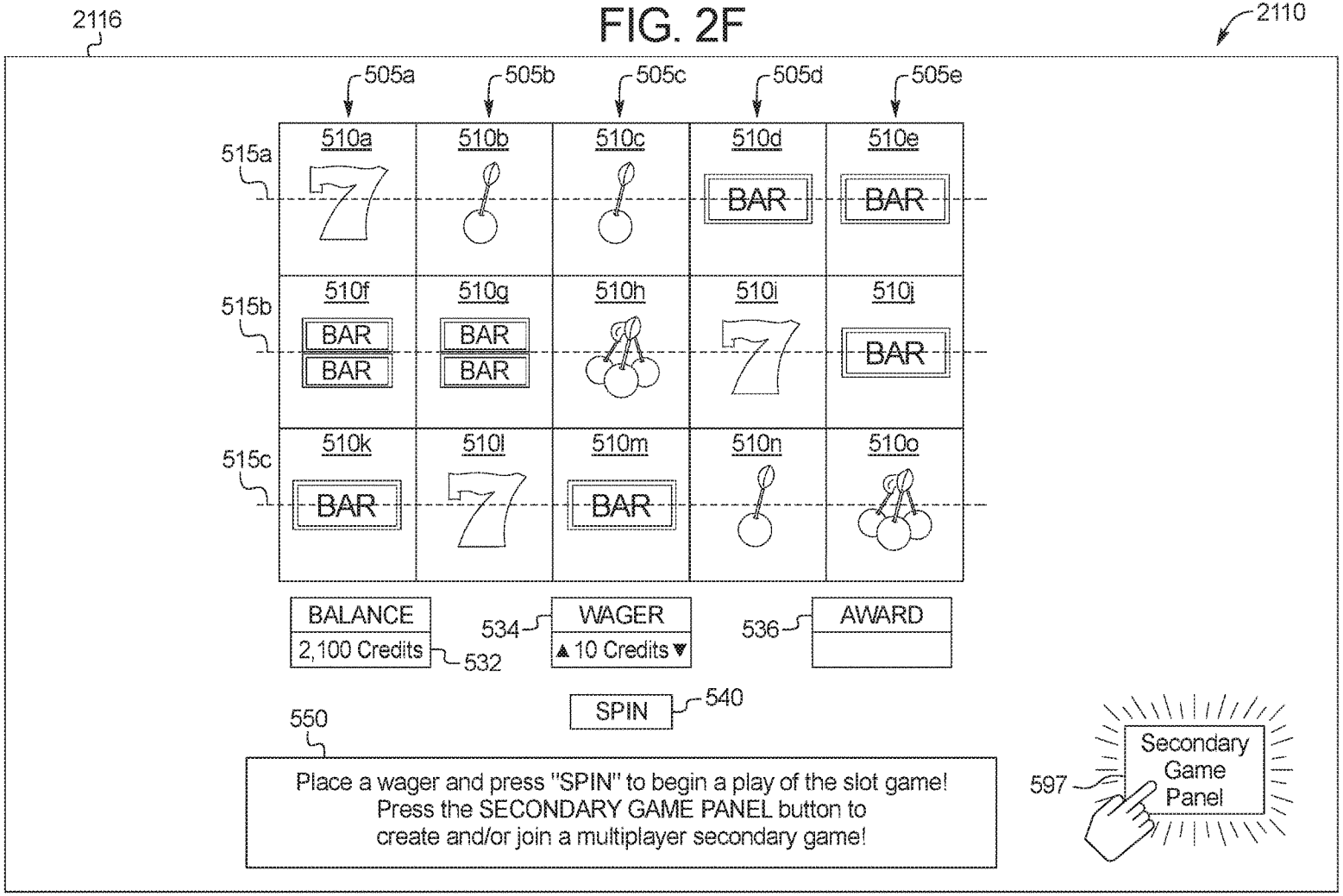
FIGS. 2F, 2G, 2H, 2I, 2J, and 2K illustrate screen shots of a second EGM as a second player enrolls in the created multiplayer secondary game.
Figure 2G:
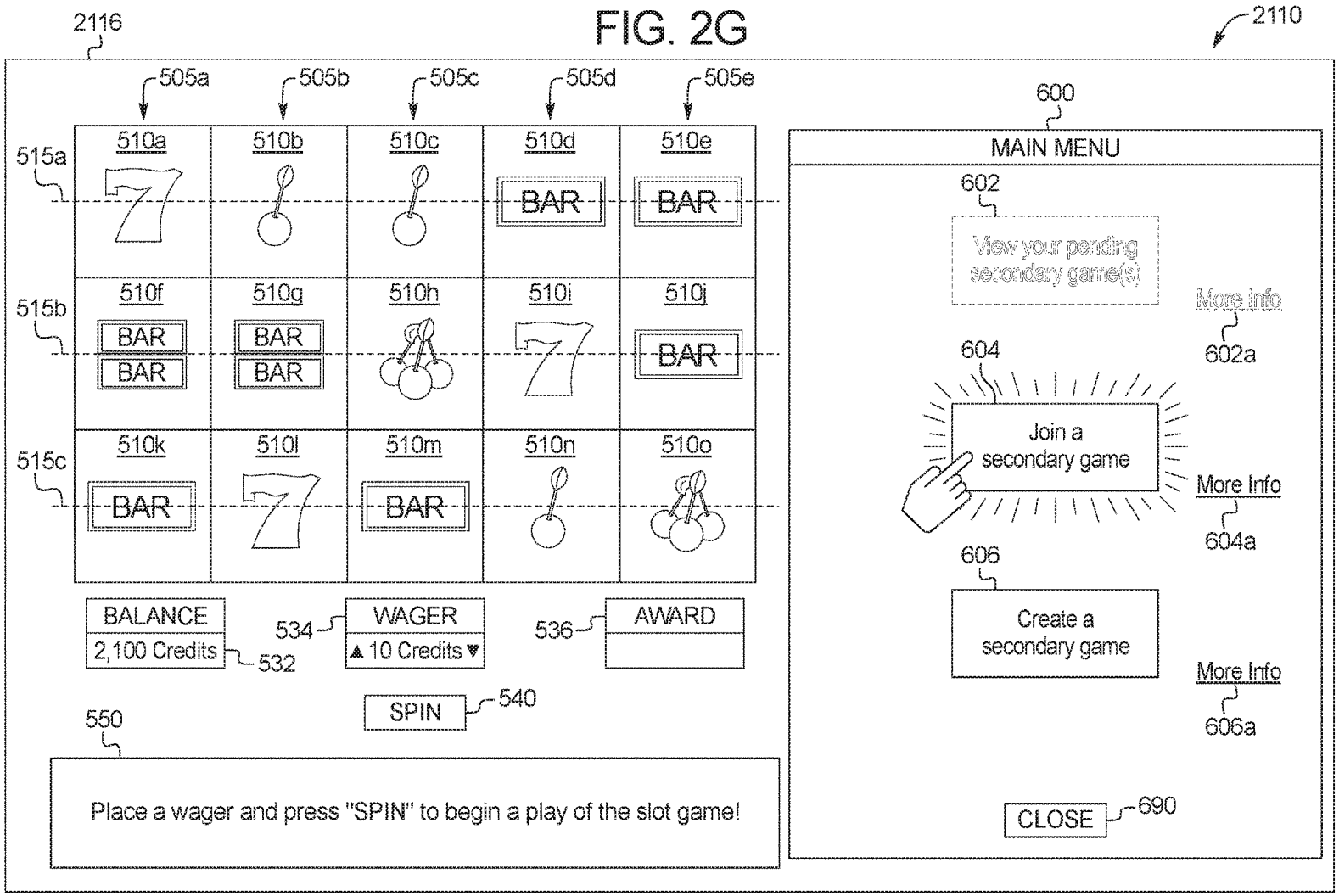
Figure 2H:
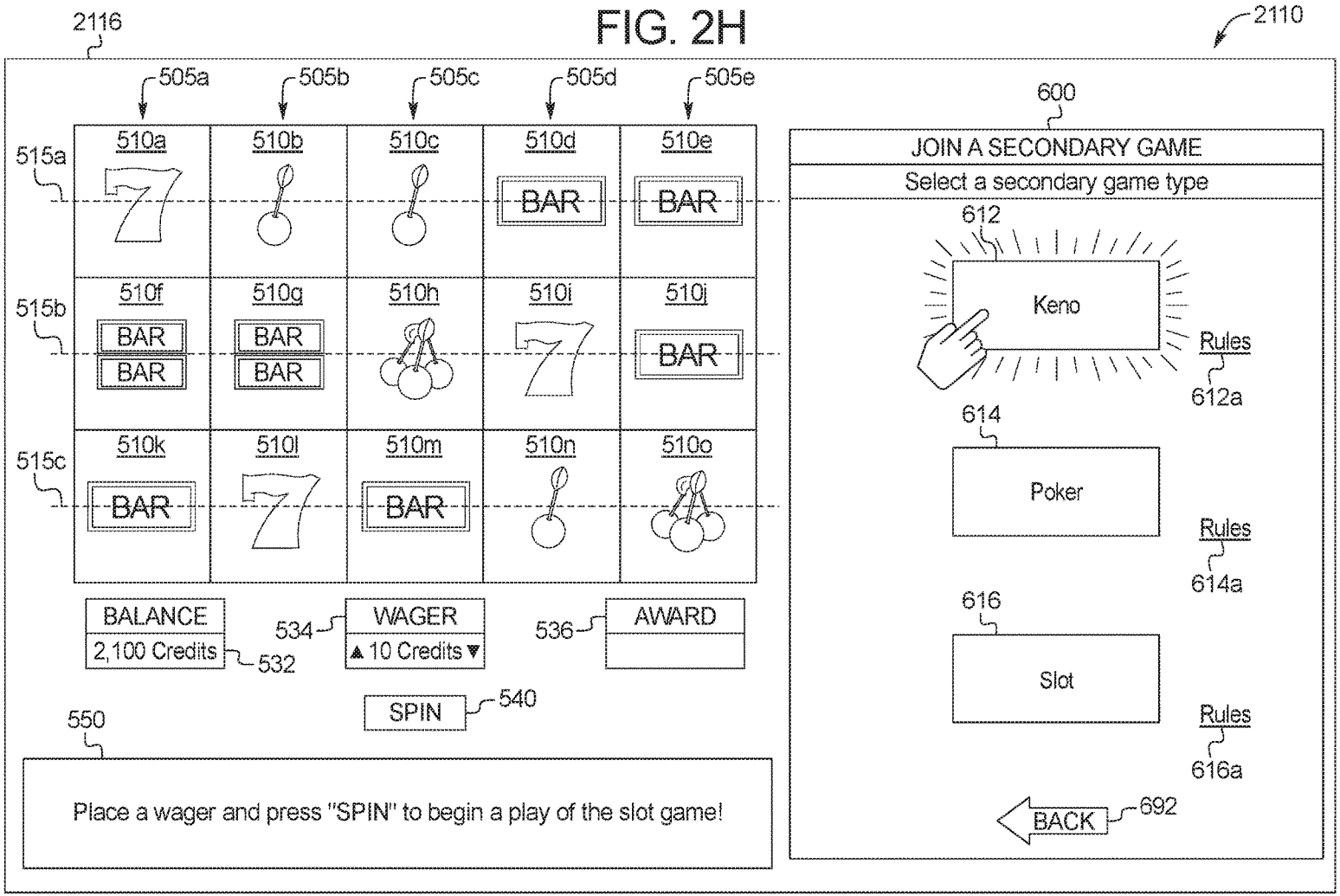
Figure 2I:
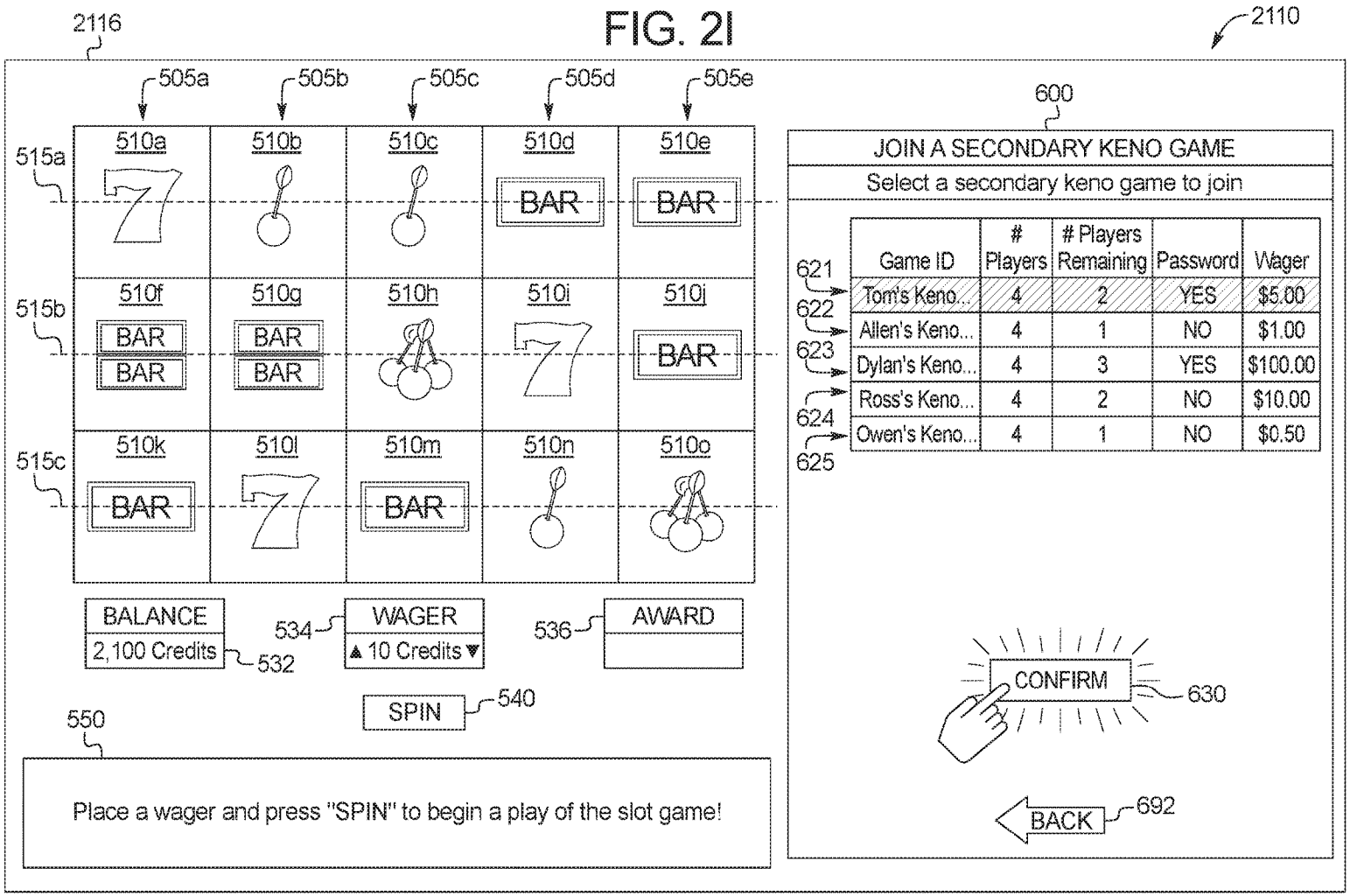
Figure 2J:
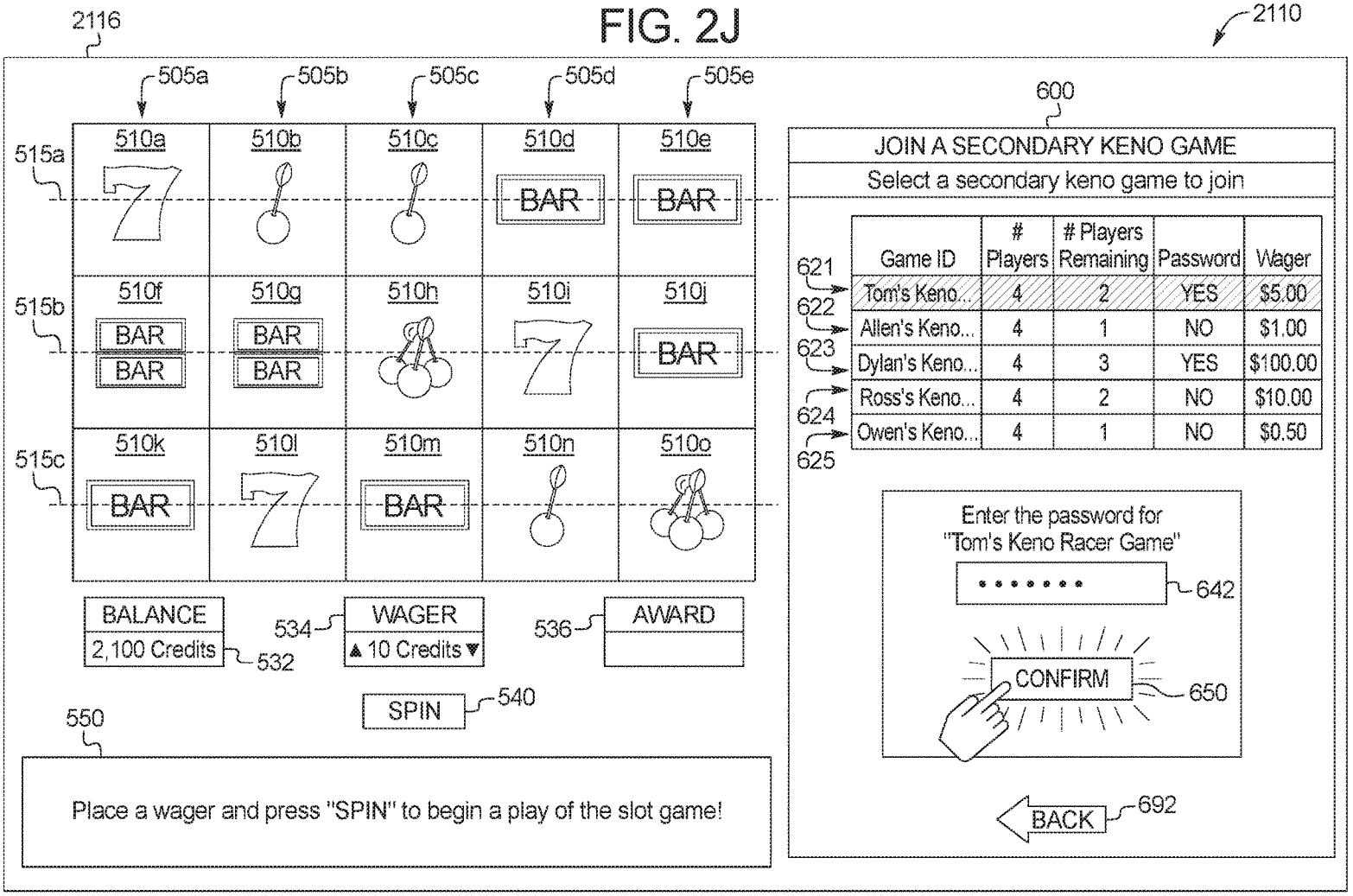
Figure 2K:
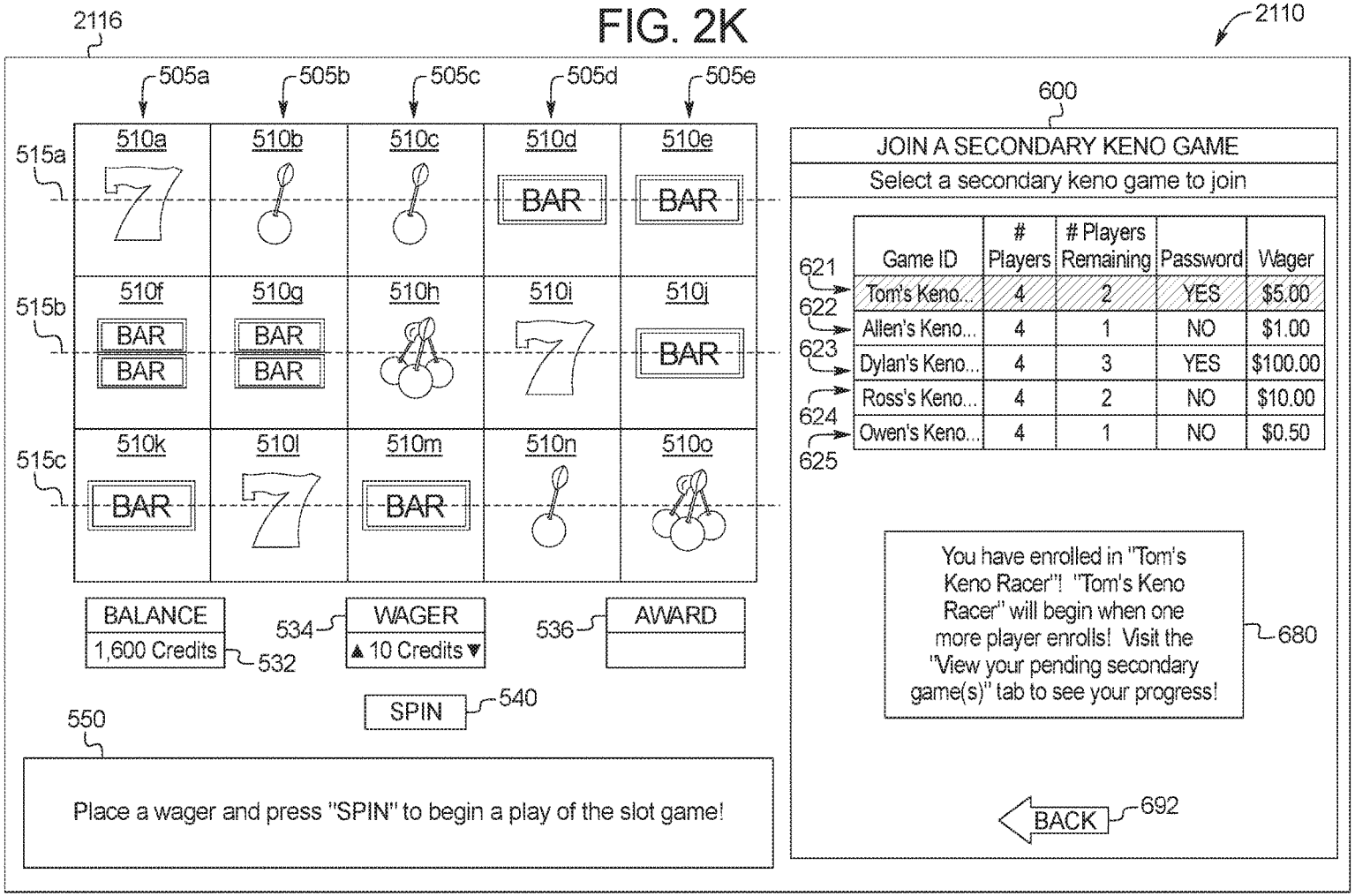
Figure 2L:
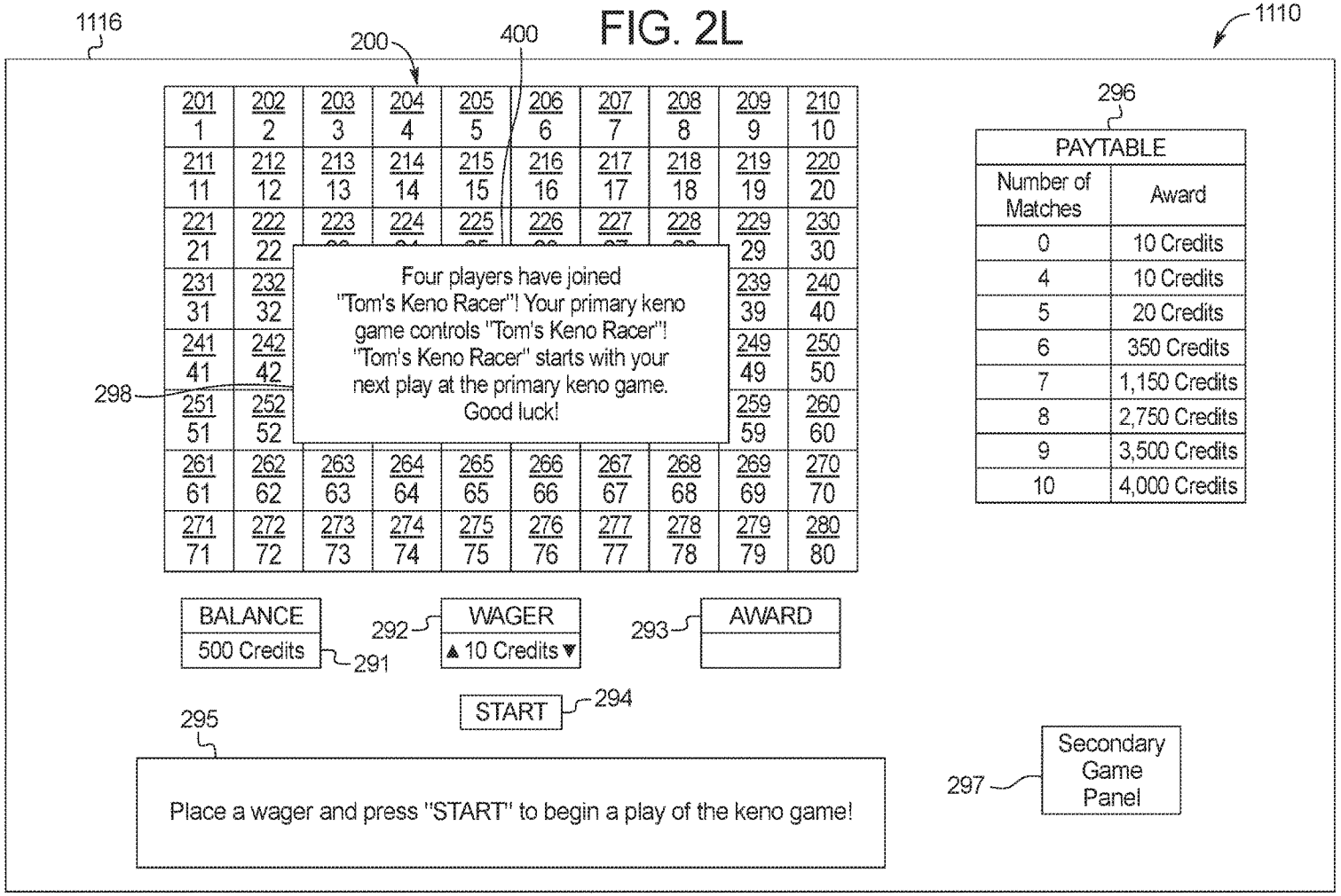
Figure 2M:
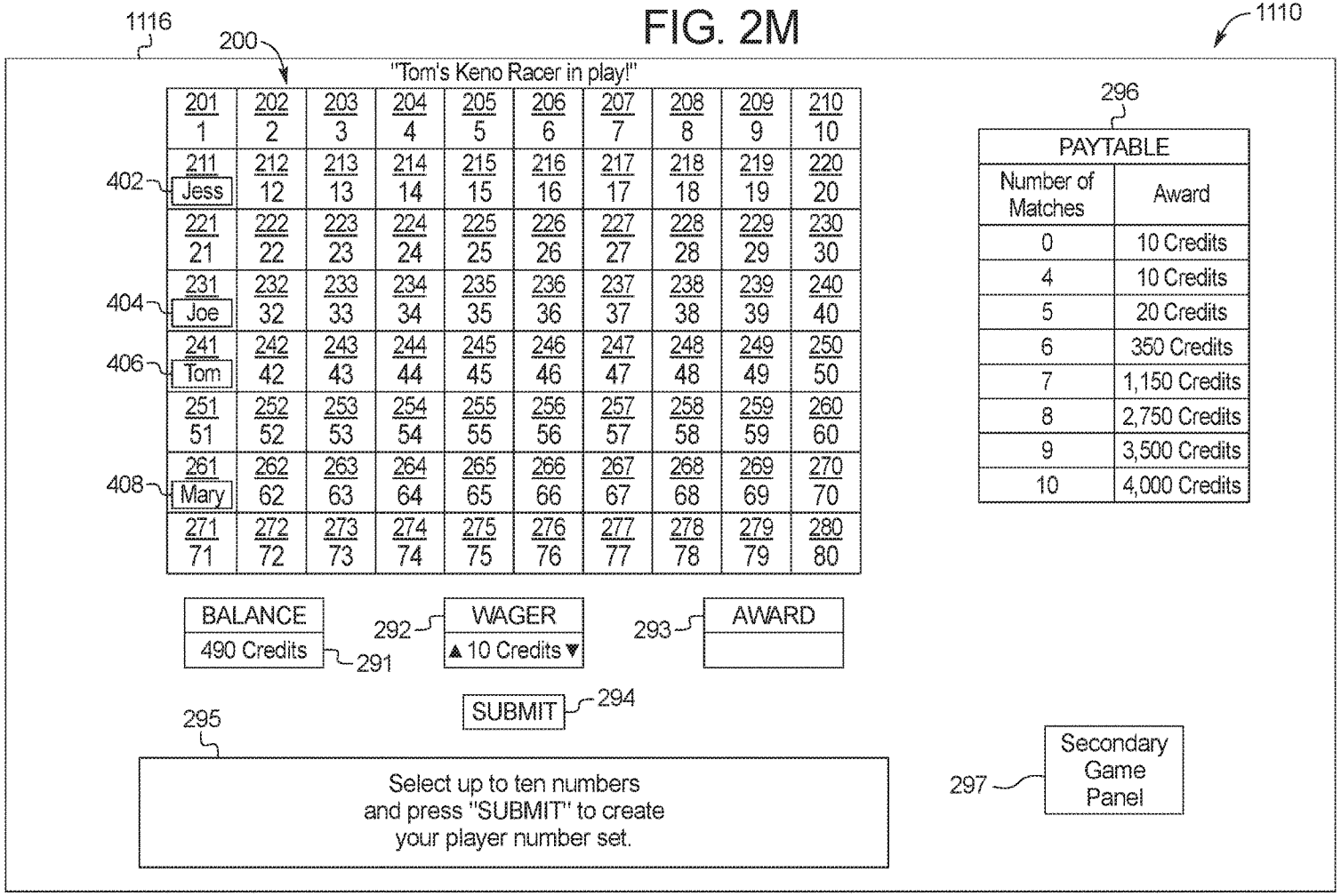
Figure 2N:
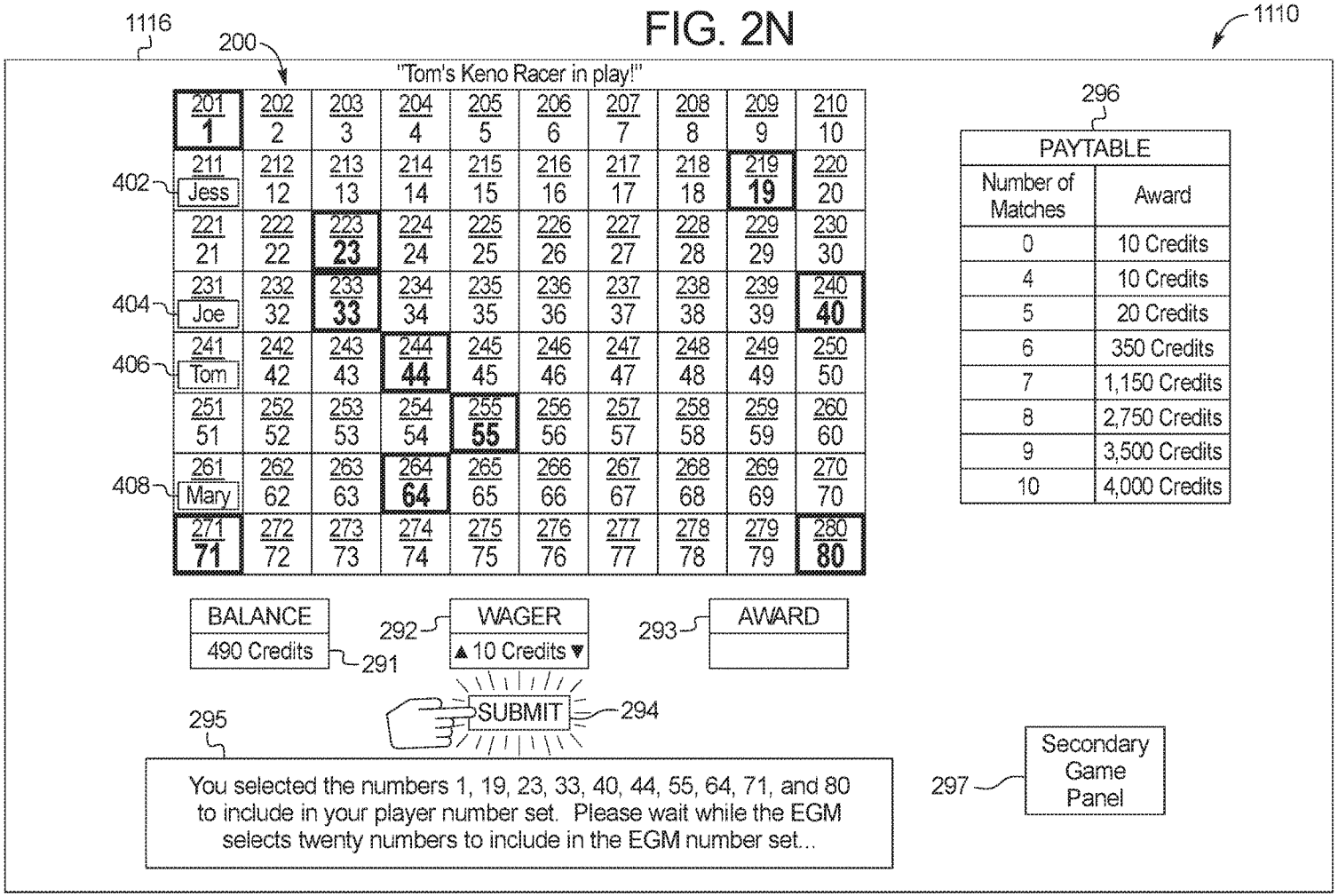
Figure 20:
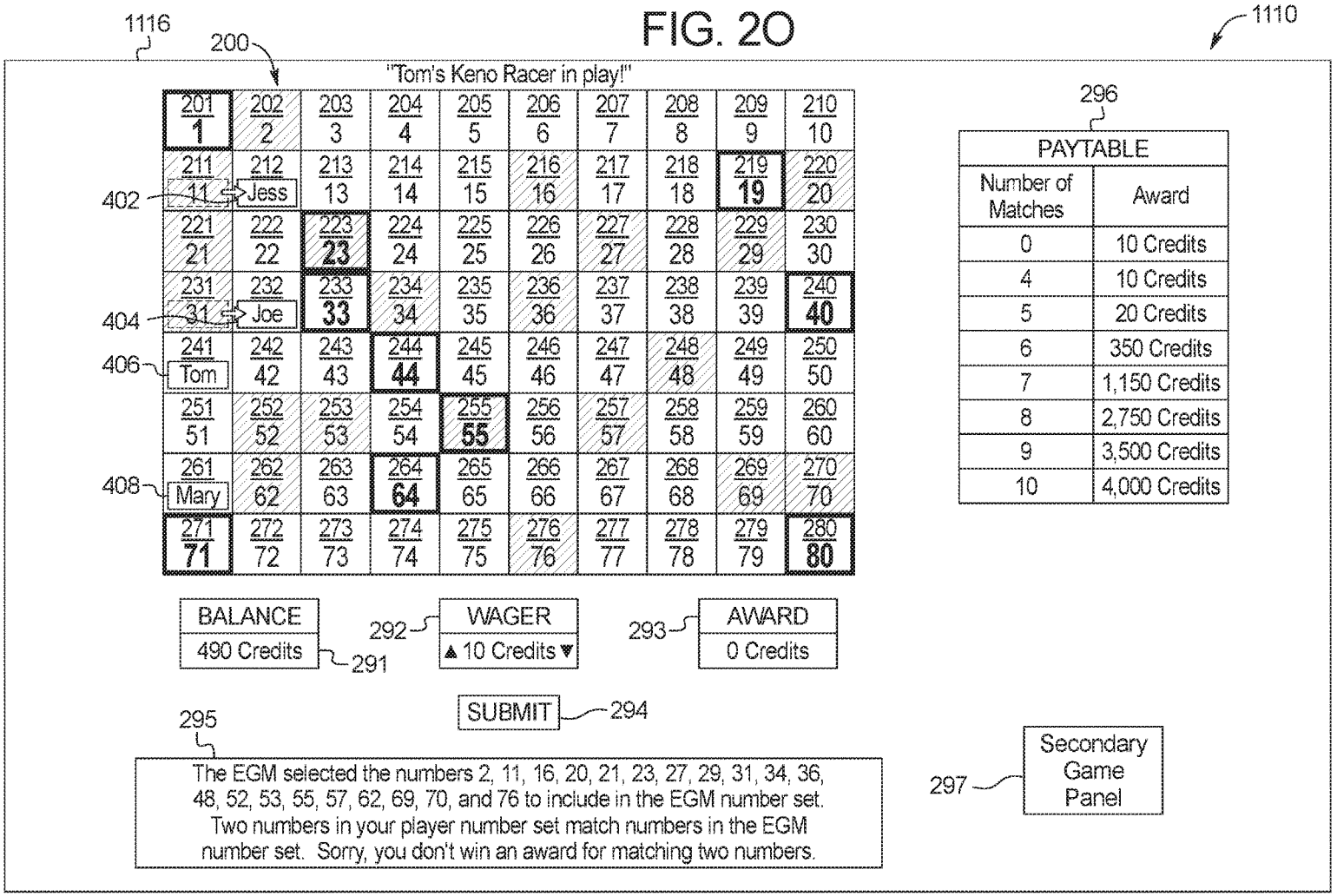
Figure 2P:
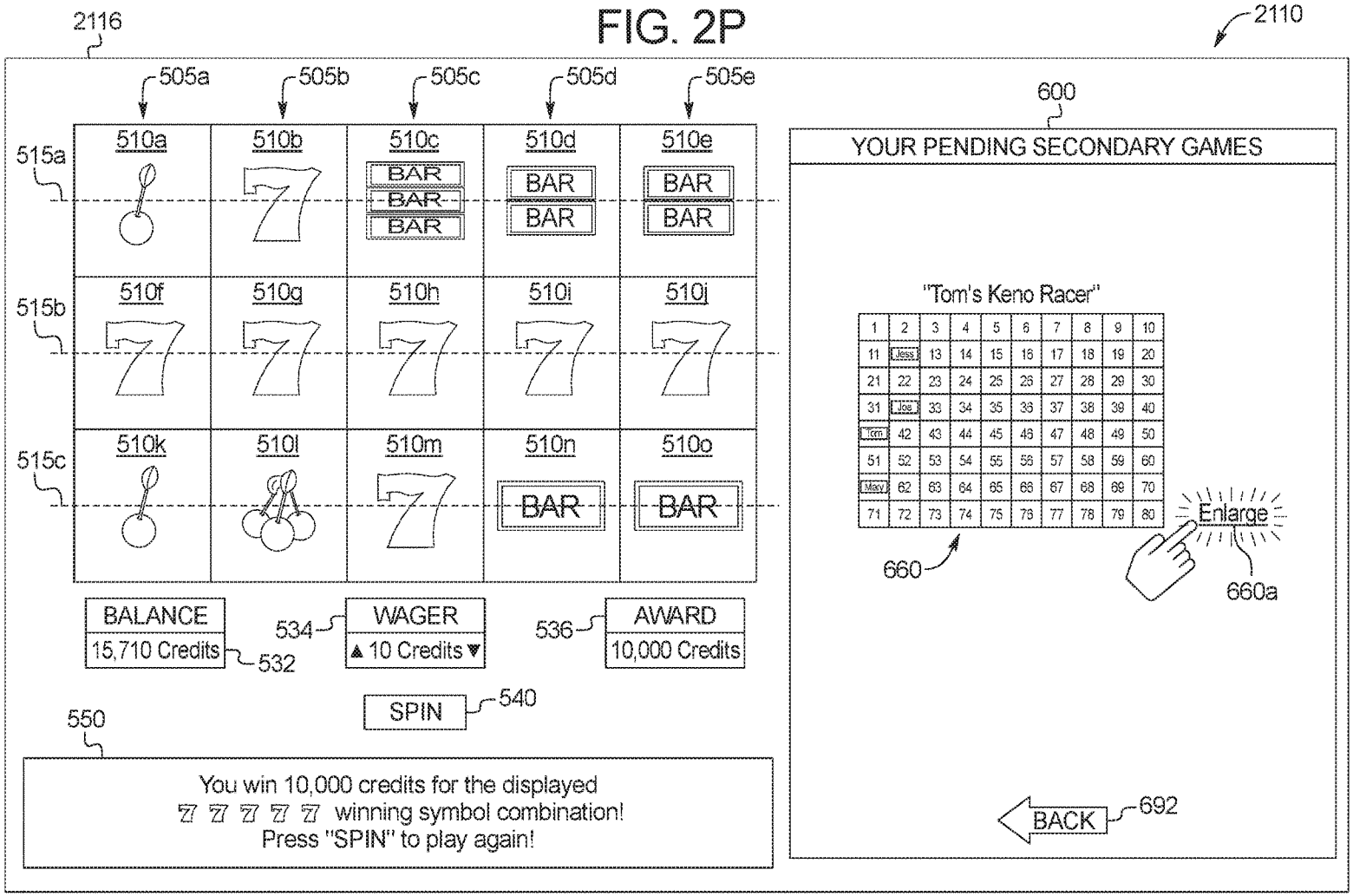
FIGS. 2P and 2Q illustrate screenshots of the second EGM during play of the created multiplayer secondary game.
Figure 2Q:
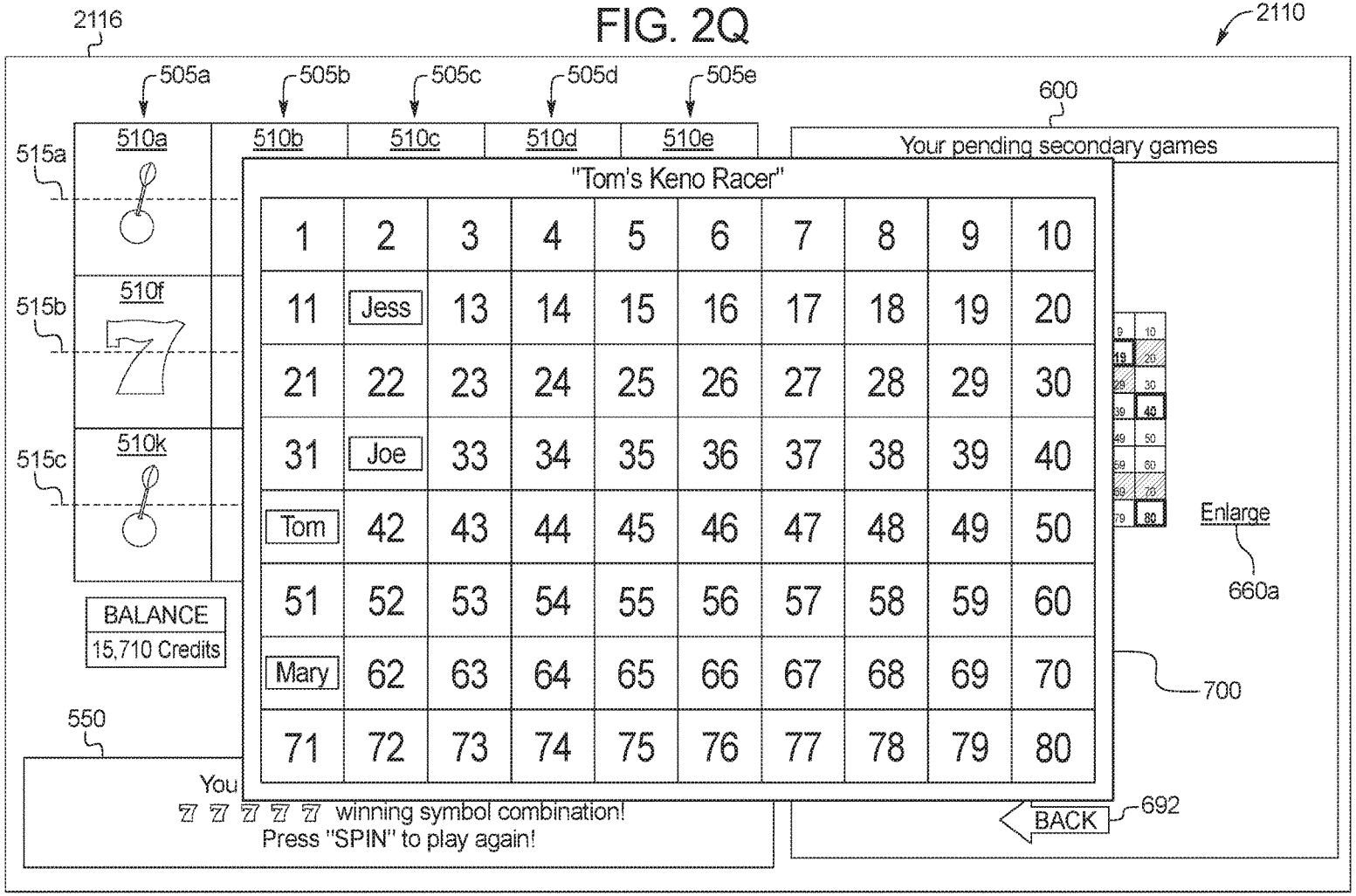

Turning to FIGS. 2A to 2Q, in one example embodiment, the gaming system includes a server (not shown) and a plurality of EGMs including at least a first EGM 1110, a second EGM 2110, a third EGM (not shown), and a fourth EGM (not shown). The server and the EGMs are configured to communicate with one another (as described in detail below). It should be appreciated that while certain components of the gaming system are described below as performing certain functions, in other embodiments any other suitable components of the gaming system may perform such functions alone or in combination with one or more other components. Generally, in this example embodiment, the EGMs enable their respective players to play individual primary games. The server coordinates, maintains, and provides the multiplayer secondary games.

The server enables the players of the EGMs to enroll in and participate in a multiplayer secondary game by either: (a) creating and enrolling in a multiplayer secondary game, (b) enrolling in a multiplayer secondary game already created by another player, or (c) creating and enrolling in a multiplayer secondary game and enrolling in another multiplayer secondary game already created by another player.

In this example embodiment, once a maximum number of players has enrolled in a particular multiplayer secondary game, the server provides that multiplayer secondary game in association with one or more plays of the primary game of a designated one of the players of the multiplayer secondary game and independent of any plays of any primary games of the other players of the multiplayer secondary game. It should thus be appreciated that, in this example embodiment, the progress and pace of the multiplayer secondary game are based on one or more plays of the primary game of the designated player, regardless of any plays of any primary games of the other players of the multiplayer secondary game.

In this example embodiment, the player who creates a multiplayer secondary game is the designated player for that multiplayer secondary game. For instance, if a first player creates and enrolls in a first multiplayer secondary game, once a maximum number of players has enrolled in the first multiplayer secondary game, the server provides the first multiplayer secondary game in association with play of the primary game played by the first player and independent of any play of any primary games of the other players of the first multiplayer secondary game. On the other hand, if that same first player enrolls in a second different multiplayer secondary game already created by a second different player, the server provides the second multiplayer secondary game in association with play of the primary game played by the second player (i.e., the player who created the second multiplayer secondary game) and independent of any play of any primary games of the first player (and any other players of the second multiplayer secondary game).

There are three different available multiplayer secondary games in this example embodiment: (a) a keno multiplayer secondary game, (b) a poker multiplayer secondary game, and (c) a slot multiplayer secondary game, each of which is described below. It should be appreciated that these multiplayer secondary games are merely examples, and that any other suitable multiplayer secondary games may be employed in accordance with the present disclosure.

In this example embodiment, each multiplayer secondary game is associated with a particular primary game. More specifically, the keno multiplayer secondary game is associated with a primary keno game, the poker multiplayer secondary game is associated with a primary poker game, and the slot multiplayer secondary game is associated with a primary slot game. In this example embodiment, the server or the EGM determines which multiplayer secondary game to enable a player to create based on the primary game that the player is playing. More specifically, the server and/or the EGM enables a player to create a multiplayer secondary game associated with the primary game that the player is playing and does not enable the player to create a multiplayer secondary game associated with a primary game that the player is not playing. For instance, in this example embodiment, if a player is playing the primary slot game, the gaming system enables that player to create the slot multiplayer secondary game, which is associated with a primary slot game, and does not enable that player to create the poker multiplayer secondary game or the keno multiplayer secondary game, which are not associated with the primary slot game. In one embodiment, the player's EGM communicates to the server which primary game the player is playing, and the server uses this information to determine which multiplayer secondary game to enable the player to create.

Turning to the keno multiplayer secondary game, in this example embodiment, the keno multiplayer secondary game is played in association with a plurality of plays of a primary keno game on an EGM of a designated player of the keno multiplayer secondary game (such as the player who created the keno multiplayer secondary game). The primary keno game (as further described below) includes eighty keno board positions arranged in an 8×10 grid or matrix including a plurality of rows and a plurality of columns. Each keno board position includes a different one of the numbers 1 through 80. For a play of the keno multiplayer secondary game: (a) the server assigns each player of the keno multiplayer secondary game a different one of the plurality of rows of keno board positions; and (b) for each player of the keno multiplayer secondary game, the designated player's EGM displays an indicator at the leftmost keno board position of the row of keno board positions with which that player is associated. For instance, if one of the players is associated with the row of keno board positions including the numbers 1 through 10, the gaming system displays that player's indicator in association with the keno board position including the number 1 (i.e., the leftmost keno board position in that particular row of keno board positions).

In this example embodiment, the keno multiplayer secondary game progresses based on the numbers that the designated player's EGM selects to include in the EGM number set for a play of the primary keno game. More specifically, in this example embodiment, for each of the indicators, the gaming system moves that indicator one keno board position to the right when the designated player's EGM selects the number included in the keno board position at which that indicator is displayed as one of the keno numbers to include in the EGM number set for a play of the primary keno game. For instance, if an indicator is displayed at the keno board position including the number 37, the gaming system moves that indicator one keno board position to the right when the designated player's EGM selects the number 37 to include in the EGM number set for a play of the primary keno game.

In this example embodiment, when: (a) one of the indicators reaches the rightmost keno board position in the row of keno board positions with which that indicator is associated, and (b) the designated player's EGM selects the number included in that rightmost keno board position (at which that indicator is displayed) as one of the numbers to include in the EGM number set for a play of the primary keno game, the server: (a) designates the player associated with that indicator as the winning player, and (b) ends the keno multiplayer secondary game. For instance, if an indicator is displayed at the keno board position including the number 40 (i.e., the rightmost keno board position in the row of the keno board positions including the numbers 31 through 40) and the designated player's EGM selects the number 40 to include in the EGM number set for a play of the primary keno game, the server designates the player associated with that indicator as the winning player and ends the multiplayer secondary game. In this example embodiment, the server provides the entire multiplayer secondary game wager pool to the winning player (or, in the event of any ties, splits the multiplayer secondary game wager pool among the multiple winning players).

It should thus be appreciated that play of the primary keno game by the designated player controls the progress of the keno multiplayer secondary game and the pace at which the keno multiplayer secondary game proceeds.

Turning to the poker multiplayer secondary game, in this example embodiment, the poker multiplayer secondary game is played in association with a one or more plays of a primary poker game on an EGM of a designated player of the poker multiplayer secondary game (such as the player who created the poker multiplayer secondary game). The primary poker game may be any suitable poker game. For a play of the poker multiplayer secondary game in an embodiment in which the poker multiplayer secondary game includes four players, the server assigns each player of the poker multiplayer secondary game a different one of a plurality of different card suits (e.g., spades, clubs, hearts, and diamonds). For a play of the poker multiplayer secondary game in an embodiment in which the poker multiplayer secondary game includes two players, the server assigns each player of the poker multiplayer secondary game a different two of the plurality of different card suits.

In this example embodiment, the poker multiplayer secondary game progresses based on the cards that the designated player's EGM deals to the designated player for a play of the primary poker game. More specifically, in this example embodiment, whenever the designated player's EGM deals to the designated player a card that is included in a Royal Flush (i.e., an Ace, a King, a Queen, a Jack, or a Ten), the gaming system: (a) determines which of the players is associated with that card's suit, and (b) assigns that card to that determined player. For instance, if a first player is assigned the suit of hearts and the designated player's EGM deals the A♥ to the designated player, the gaming system assigns the A♥ to the first player for the play of the poker multiplayer secondary game.

In this example embodiment: (a) for a play of the poker multiplayer secondary game including four players, when the cards assigned to one of the players form a Royal Flush (i.e., when the server has assigned to that player the Ace, the King, the Queen, the Jack, and the Ten of the suit assigned to that player), the server designates that player as the winning player and ends the poker multiplayer secondary game; and (b) for a play of the poker multiplayer secondary game including two players, when the cards of a first suit assigned to that player form a Royal Flush and the cards of a second different suit assigned to that player also form a Royal Flush, the server designates that player as the winning player and ends the poker multiplayer secondary game.

It should thus be appreciated that play of the primary poker game by the designated player controls the progress of the poker multiplayer secondary game and the pace at which the poker multiplayer secondary game proceeds.

Turning to the slot multiplayer secondary game, in this example embodiment, the slot multiplayer secondary game is played in association with a one or more plays of a primary slot game on an EGM of a designated player of the slot multiplayer secondary game (such as the player who created the slot multiplayer secondary game). The primary slot game may be any suitable slot game. For a play of the slot multiplayer secondary game, the server assigns each player of the slot multiplayer secondary game a different one of a plurality of different symbols included on a plurality of reels of the primary slot game.

In this example embodiment, the slot multiplayer secondary game progresses based on the symbols that the designated player's EGM displays after spinning and stopping the reels for a play of the primary slot game. More specifically, in this example embodiment, whenever the designated player's EGM spins and stops the reels, for each player of the slot multiplayer secondary game, the server: (a) determines a quantity of the displayed symbols that are associated with that player, and (b) increments a counter associated with that player by that determined quantity. For instance, if a first player is assigned a SEVEN symbol, after each play of the primary slot game, the server determines a quantity of SEVEN symbols that are displayed and increments a counter associated with the first player by that determined quantity. In this example embodiment, when the counter of one of the players reaches a designated quantity, the server designates that player as the winning player and ends the slot multiplayer secondary game.

In another embodiment, whenever the designated player's EGM spins and stops the reels, for each player of the slot multiplayer secondary game, the server determines whether the displayed symbols form a designated combination of symbols that are associated with that player. For instance, if a first player is assigned a SEVEN symbol, after each play of the primary slot game, the server determines whether a designated combination of SEVEN symbols is displayed. In this example embodiment, when such a designated symbol combination is displayed for one of the players, the server designates that player as the winning player and ends the slot multiplayer secondary game.

It should thus be appreciated that play of the primary slot game by the designated player controls the progress of the slot multiplayer secondary game and the pace at which the slot multiplayer secondary game proceeds.

FIGS. 2A, 2B, 2C, 2D, and 2E illustrate screen shots of the first EGM 1110 as a first player of the first EGM 1110 creates and enrolls in a multiplayer secondary game. As shown in FIG. 2A, in this example embodiment, the first EGM 1110 provides a first primary game, which is a keno game in this example embodiment. More specifically, the first EGM 1110 displays (such as on a display device 1116, described below) a keno board 200 including a plurality of keno board positions 201 through 280 arranged in an 8×10 grid or matrix including a plurality of rows and a plurality of columns. The first EGM 1110 displays an indication of a different one of the numbers 1 through 80 at each of the keno board positions.

The first EGM 1110 also displays: (a) a plurality of meters including: (i) a credit meter 291 that displays the first player's credit balance (in credit or currency form), (ii) a wager or bet meter 292 that displays any wager or bet placed by the first player on a play of the primary keno game (in credit or currency form), and (iii) an award meter 293 that displays any awards won for any plays of the primary keno game (in credit or currency form); (b) a START button 294 that, when actuated by the first player, causes the first EGM 1110 to initiate a play of the primary keno game; (c) a message box 295 that displays a variety of messages or indications before, during, or after play of the primary keno game; (d) a paytable 296 for the primary keno game that indicates a plurality of different numbers of matches and an award associated with each such number of matches; and (e) a SECONDARY GAME PANEL button 297 that, when actuated by the first player, causes the first EGM 1110 to display a secondary game panel 300 (described below).

As shown in FIG. 2A, in this example embodiment, the first EGM 1110 displays the following message in the message box 295 upon receiving value from the first player: "PLACE A WAGER AND PRESS 'START' TO BEGIN A PLAY OF THE KENO GAME! PRESS THE SECONDARY GAME PANEL BUTTON TO CREATE AND/OR JOIN A MULTIPLAYER SECONDARY GAME!" The first EGM 1110 receives an actuation of the SECONDARY GAME PANEL button 297 from the first player.

Accordingly, as shown in FIG. 2B, the first EGM 1110 displays the secondary game panel 300. More specifically, upon receiving the actuation of the SECONDARY GAME PANEL button 297, the first EGM 1110 displays a MAIN MENU screen in the secondary game panel 300. The MAIN MENU screen includes: (a) a VIEW YOUR PENDING SECONDARY GAME(S) button 302 that, when actuated by the first player, causes the first EGM 1110 to display a status of any multiplayer secondary games in which the first player has already enrolled; (b) a JOIN A SECONDARY GAME button 304 that, when actuated by the first player, causes the first EGM 1110 to enable the first player to enroll in any multiplayer secondary games that have not yet started and for which the first player qualifies; (c) a CREATE A SECONDARY GAME button 306 that, when actuated by the first player, causes the first EGM 1110 to enable the first player to create a multiplayer secondary game; and (d) a CLOSE button 390 that, when actuated by the first player, causes the first EGM 1110 to close the secondary game panel 300. It should be appreciated that the MAIN MENU screen may include any other suitable buttons having any other suitable functionality instead of, or in addition to, any of those described above.

At this point in this example embodiment, the first player is not enrolled in any multiplayer secondary games. Accordingly, the first EGM 1110 deactivates and fades or otherwise deemphasizes the VIEW YOUR PENDING SECONDARY GAME(S) button 302 to indicate that the VIEW YOUR PENDING SECONDARY GAME(S) button may not be actuated by the first player at this point. It should be appreciated that once the first player enrolls in at least one multiplayer secondary game, the first EGM activates the VIEW YOUR PENDING SECONDARY GAME(S) button such that the first player may actuate that button.

The secondary game panel 300 also includes MORE INFO buttons (such as hyperlinks) 302*a*, 304*a*, and 306*a*, which are respectively associated with the VIEW YOUR PENDING SECONDARY GAME(S) button 302, the JOIN A SECONDARY GAME button 304, and the CREATE A SECONDARY GAME button 306. Each MORE INFO button, when actuated by the first player, causes the first EGM 1110 to provide additional information regarding the button with which that MORE INFO button is associated. For instance, when the first EGM 1110 receives an actuation of the MORE INFO button 302*a*, the first EGM 1110 displays or otherwise provides additional information (not shown) to the first player regarding the VIEW YOUR PENDING SECONDARY GAME(S) button 302.

As shown in FIG. 2B, the first EGM 1110 receives an actuation of the CREATE A SECONDARY GAME button 306 from the first player.

Accordingly, as shown in FIG. 2C, the first EGM 1110 displays a CREATE A SECONDARY GAME—SELECT A SECONDARY GAME TYPE screen in the secondary game panel 300. The CREATE A SECONDARY GAME—SELECT A SECONDARY GAME TYPE screen includes: (a) a KENO button 312 that, when actuated by the first player, indicates that the first player desires to create a keno multiplayer secondary game (described above); (b) a POKER button 314 that, when actuated by the first player, indicates that the first player desires to create a poker multiplayer secondary game (described above); (c) a FAVORITE CHARACTER button 316 that, when actuated by the first player, indicates that the first player desires to create a slot multiplayer secondary game (described above); and (d) a BACK button 392 that, when actuated by the first player, causes the first EGM 1110 to return to the previous screen. It should be appreciated that the CREATE A SECONDARY GAME—SELECT A SECONDARY GAME TYPE screen may include any other suitable buttons having any other suitable functionality instead of, or in addition to, any of those described above.

The secondary game panel 300 also includes RULES buttons (such as hyperlinks) 312*a*, 314*a*, and 316*a*, which are respectively associated with the KENO button 312, the POKER button 314, and the SLOT button 316. Each RULES button, when actuated by the first player, causes the first EGM 1110 to provide additional information regarding the rules of the type of multiplayer secondary game associated with the button with which that RULES button is associated. For instance, when the first EGM 1110 receives an actuation of the RULES button 312*a*, the first EGM 1110 displays or otherwise provides additional information (not shown) to the first player regarding the rules of the keno multiplayer secondary game (which is associated with the KENO button 312).

As explained above, in this example embodiment, each multiplayer secondary game is associated with a different primary game, and the server enables a player to create a multiplayer secondary game that is associated with the primary game being played by the player and does not enable the player to create a multiplayer secondary game that is associated with a primary game not being played by the player. Since, in this example embodiment, the first player is playing a primary keno game, the gaming system enables the first player to create the keno multiplayer secondary game (which is associated with a primary keno game) and does not enable the first player to create the poker multiplayer secondary game or the slot multiplayer secondary game (which are not associated with the primary keno game). Accordingly, the first EGM 1110 fades or otherwise deemphasizes the POKER button 314 and the SLOT button 316 to indicate that those buttons may not be actuated by the first player at this point.

As shown in FIG. 2C, the first EGM 1110 receives an actuation of the KENO button 312 from the first player.

Accordingly, as shown in FIG. 2D, the first EGM 1110 displays a CREATE A SECONDARY KENO GAME—SET SECONDARY KENO GAME ATTRIBUTES screen in the secondary game panel 300. The SECONDARY KENO GAME—SET SECONDARY KENO GAME ATTRIBUTES screen includes: (a) a Number of Players drop box 322 that, when actuated by the first player, causes the first EGM 1110 to enable the first player to select the maximum number of players that may enroll in and participate in the keno multiplayer secondary game; (b) a Password Protected drop box 324 that, when actuated by the first player, causes the first EGM 1110 to enable the first player to indicate whether the first player desires the gaming system to password protect the keno multiplayer secondary game; (c) a Password box 326 that displays a password (such as a player-created password or a gaming system-created password) required to enroll in the keno multiplayer secondary game; (d) a Change button 326*a* that, when actuated by the first player, causes the first EGM 1110 to enable the first player to change the password displayed in the Password box 326; (e) a Secondary Game Wager drop box 328 that, when actuated by the first player, causes the first EGM 1110 to enable the first player to select a wager amount that a player must place on the multiplayer secondary game when enrolling in the multiplayer secondary game; (f) a Secondary Game ID box 330 that displays an identifying name of the multiplayer secondary game (such as a player-created identifying name or a gaming system-created identifying name); (g) a Change button 330*a* that, when actuated by the first player, causes the first EGM 1110 to enable the first player to change the identifying name of the multiplayer secondary game displayed in the Secondary Game ID box 330; (h) a CREATE SECONDARY GAME button 332 that, when actuated by the first player, indicates that the first player desires to create a multiplayer secondary game with the indicated attributes; and (i) the BACK button 392. It should be appreciated that the SECONDARY KENO GAME-SET SECONDARY KENO GAME ATTRIBUTES GAME TYPE screen may include any other suitable buttons having any other suitable functionality instead of, or in addition to, any of those described above.

As illustrated in FIG. 2D, the first player: (a) selected a maximum number of four players for the multiplayer secondary game, (b) selected to password protect the multiplayer secondary game, (c) selected a password of "KENO FUN", (d) selected a secondary game wager of $5.00, and (e) selected an identifying name for the multiplayer secondary game of "Tom's Keno Racer." The first EGM 1110 receives an actuation of the CREATE SECONDARY GAME BUTTON 332 from the first player.

Accordingly, the server enrolls the first player in the "Tom's Keno Racer" multiplayer secondary game, and, as shown in FIG. 2E, the first EGM 1110 deducts the secondary game wager of $5.00 (which is 500 credits in this example embodiment) from the first player's credit balance (as shown in the credit meter 291) and displays a dialog box 380 in the secondary game panel 300 including the following message: "SECONDARY KENO GAME 'TOM'S KENO RACER' HAS BEEN CREATED AND YOU HAVE ENROLLED. 'TOM'S KENO RACER' WILL BEGIN WHEN THREE MORE PLAYERS ENROLL!"

FIGS. 2F, 2G, 2H, 2I, 2J, and 2K illustrate screen shots of the second EGM 2110 as a second player of the second EGM 2110 enrolls in the "Tom's Keno Racer" multiplayer secondary game. As shown in FIG. 2F, in this example embodiment, the second EGM 2110 provides a second primary game, which is a slot game in this example embodiment.

More specifically, the second EGM 2110 displays (such as on a display device 2116, described below), a plurality of symbol display areas 510*a*, 510*b*, 510*c*, 510*d*, 510*e*, 510*f*, 510*g*, 510*h*, 510*i*, 510*j*, 510*k*, 510*l*, 510*m*, 510*n*, and 510*o* arranged in a 3×5 grid or matrix. The second EGM 2110 also displays a plurality of reels 505*a*, 505*b*, 505*c*, 505*d*, and 505*e*, each of which is associated with a plurality of a plurality of symbols the second EGM 2110 employs for the primary slot game. Each of the reels 505*a*, 505*b*, 505*c*, 505*d*, and 505*e* is associated with, and configured to display symbols at, a plurality of the symbol display areas. More specifically: (a) the reel 505*a* is associated with, and configured to display symbols at, the symbol display areas 510*a*, 510*f*, and 510*k*; (b) the reel 505*b* is associated with, and configured to display symbols at, the symbol display areas 510*b*, 510*g*, and 510*l*; (c) the reel 505*c* is associated with, and configured to display symbols at, the symbol display areas 510*c*, 510*h*, and 510*m*; (d) the reel 505*d* is associated with, and configured to display symbols at, the symbol display areas 510*d*, 510*i*, and 510*n*; and (e) the reel 505*e* is associated with, and configured to display symbols at, the symbol display areas 510*e*, 510*j*, and 510*o*.

The second EGM 2110 displays a plurality of paylines 515*a*, 515*b*, and 515*c*, each of which is associated with a different plurality of the symbol display areas. More specifically: (a) the payline 515*a* is associated with the symbol display areas 510*a*, 510*b*, 510*c*, 510*d*, and 510*e*; (b) the payline 515*b* is associated with the symbol display areas 510*f*, 510*g*, 510*h*, 510*i*, and 510*j*; and (c) the payline 515*c* is associated with the symbol display areas 510*k*, 510*l*, 510*m*, 510*n*, and 510*o*.

The second EGM 2110 also displays: (a) a plurality of meters including: (i) a credit meter 532 that displays the second player's credit balance (in credit or currency form), (ii) a wager or bet meter 534 that displays any wager or bet placed by the second player on a play of the primary slot game (in credit or currency form), and (iii) an award meter 536 that displays any awards won for any plays of the primary slot game (in credit or currency form); (b) a SPIN button 540 that, when actuated by the second player, causes the second EGM 2110 to initiate a play of the primary slot game; (c) a message box 550 that displays a variety of messages or indications before, during, or after play of the primary slot game; and (d) a SECONDARY GAME PANEL button 597 that, when actuated by the second player, causes the second EGM 2110 to display a secondary game panel 600 (described below).

As shown in FIG. 2F, in this example embodiment, the second EGM 2110 displays the following message in the message box 550 upon receiving value from the second player: "PLACE A WAGER AND PRESS 'SPIN' TO BEGIN A PLAY OF THE SLOT GAME! PRESS THE SECONDARY GAME PANEL BUTTON TO CREATE AND/OR JOIN A MULTIPLAYER SECONDARY GAME!" The second EGM 2110 receives an actuation of the SECONDARY GAME PANEL button 597 from the second player.

Accordingly, as shown in FIG. 2G, the second EGM 2110 displays the secondary game panel 600. More specifically, upon receiving the actuation of the SECONDARY GAME PANEL button 597, the second EGM 2110 displays a MAIN MENU screen in the secondary game panel 600. The MAIN MENU screen is substantially the same as the MAIN MENU screen described above, and includes: (a) a VIEW YOUR PENDING SECONDARY GAME(S) button 602 that, when actuated by the second player, causes the second EGM 2110 to display a status of any multiplayer secondary games in which the second player has already enrolled; (b) a JOIN A SECONDARY GAME button 604 that, when actuated by the second player, causes the second EGM 2110 to enable the second player to enroll in any multiplayer secondary games that have not yet started and for which the second player qualifies; (c) a CREATE A SECONDARY GAME button 606 that, when actuated by the second player, causes the second EGM 2110 to enable the second player to create a multiplayer secondary game; and (d) a CLOSE button 690 that, when actuated by the second player, causes the second EGM 2110 to close the secondary game panel 600. It should be appreciated that the MAIN MENU screen may include any other suitable buttons having any other suitable functionality instead of, or in addition to, any of those described above.

At this point in this example embodiment, the second player is not enrolled in any multiplayer secondary games. Accordingly, the second EGM 2110 deactivates and fades or otherwise deemphasizes the VIEW YOUR PENDING SECONDARY GAME(S) button 602 to indicate that the VIEW YOUR PENDING SECONDARY GAME(S) button may not be actuated by the second player at this point. It should be appreciated that once the second player enrolls in at least one multiplayer secondary game, the second EGM activates the VIEW YOUR PENDING SECONDARY GAME(S) button such that the second player may actuate that button.

The secondary game panel 600 also includes MORE INFO buttons (such as hyperlinks) 602*a*, 604*a*, and 606*a*, which are respectively associated with the VIEW YOUR PENDING SECONDARY GAME(S) button 602, the JOIN A SECONDARY GAME button 604, and the CREATE A SECONDARY GAME button 606. Each MORE INFO button, when actuated by the second player, causes the second EGM 2110 to provide additional information regarding the button with which that MORE INFO button is associated. For instance, when the second EGM 2110 receives an actuation of the MORE INFO button 602*a*, the second EGM 2110 displays or otherwise provides additional information (not shown) to the second player regarding the VIEW YOUR PENDING SECONDARY GAME(S) button 602.

As shown in FIG. 2G, the second EGM 2110 receives an actuation of the JOIN A SECONDARY GAME button 604 from the second player.

Accordingly, as shown in FIG. 2H, the second EGM 2110 displays a JOIN A SECONDARY GAME—SELECT A SECONDARY GAME TYPE screen in the secondary game panel 600. The JOIN A SECONDARY GAME—SELECT A SECONDARY GAME TYPE screen includes: (a) a KENO button 612 that, when actuated by the second player, indicates that the first player desires to join a keno multiplayer secondary game (described above); (b) a POKER button 614 that, when actuated by the second player, indicates that the second player desires to join a poker multiplayer secondary game (described above); (c) a SLOT button 616 that, when actuated by the second player, indicates that the second player desires to join a slot multiplayer secondary game (described above); and (d) a BACK button 392 that, when actuated by the second player, causes the second EGM 2110 to return to the previous screen. It should be appreciated that the JOIN A SECONDARY GAME—SELECT A SECONDARY GAME TYPE screen may include any other suitable buttons having any other suitable functionality instead of, or in addition to, any of those described above.

The secondary game panel 600 also includes RULES buttons (such as hyperlinks) 612*a*, 614*a*, and 616*a*, which are respectively associated with the KENO button 612, the POKER button 614, and the SLOT button 616. Each RULES button, when actuated by the second player, causes the second EGM 2110 to provide additional information regarding the rules of the type of multiplayer secondary game associated with the button with which that RULES button is associated. For instance, when the second EGM 2110 receives an actuation of the RULES button 612*a*, the second EGM 2110 displays or otherwise provides additional information (not shown) to the second player regarding the rules of the keno multiplayer secondary game (which is associated with the KENO button 612).

In this example embodiment, because the player who creates a multiplayer secondary game (and not any player who subsequently enrolls in that multiplayer secondary game) is the designated player for that multiplayer secondary game, the server enables a player to join any available multiplayer secondary games for which the player qualifies regardless of the type of primary game being played by the player. Thus, in this example embodiment, the gaming system enables the second player to enroll in a keno multiplayer secondary game, a poker multiplayer secondary game, and/or a slot multiplayer secondary game.

As shown in FIG. 2H, the second EGM 2110 receives an actuation of the KENO button 312 from the first player.

Accordingly, as shown in FIG. 2I, the second EGM 1110 displays a JOIN A SECONDARY KENO GAME—SELECT A SECONDARY KENO GAME TO JOIN screen in the secondary game panel 600. The JOIN A SECONDARY KENO GAME—SELECT A SECONDARY KENO GAME TO JOIN screen includes a list of available keno multiplayer secondary games 621, 622, 623, 624, and 625 for which the second player is qualified and in which the second player may enroll. The second EGM 2110 receives a selection of the "Tom's Keno Racer" multiplayer secondary game 621 and an actuation of a CONFIRM button 630 from the second player.

Accordingly, as shown in FIG. 2J, since the "Tom's Keno Racer" multiplayer secondary game is password protected, the second EGM 2110 requires the second player to enter the password associated with the "Tom's Keno Racer" multiplayer secondary game in a password entry box 642 before enrolling the second player in the "Tom's Keno Racer" multiplayer secondary game. The second EGM 2110 receives an input a password and an actuation of a CONFIRM button 650 from the second player. The server verifies that the password matches the password associated with the "Tom's Keno Racer" multiplayer secondary game and, accordingly, enrolls the second player in the "Tom's Keno Racer" multiplayer secondary game.

Accordingly, as shown in FIG. 2K, the EGM 2110 deducts the secondary game wager of $5.00 (which is 500 credits in this example embodiment) from the second player's credit balance (as shown in the credit meter 532), and displays a dialog box 680 in the secondary game panel 600 including the following message: "YOU HAVE ENROLLED IN 'TOM'S KENO RACER' !'TOM'S KENO RACER' WILL BEGIN WHEN ONE MORE PLAYER ENROLLS! VISIT THE 'VIEW YOUR PENDING SECONDARY GAME(S)' TAB TO SEE YOUR PROGRESS!"

FIGS. 2L, 2M, 2N, and 2O illustrate screen shots of the first EGM 1110 as the first player of the first EGM 1110 plays the primary keno game after the server initiates the "Tom's Keno Racer" multiplayer secondary game.

As shown in FIG. 2L, once the maximum number of four players enroll in the "Tom's Keno Racer" multiplayer secondary game, the server initiates the "Tom's Keno Racer" multiplayer secondary game, and the first EGM 1110 displays a dialog box 298 including the following message: "FOUR PLAYERS HAVE JOINED 'TOM'S KENO RACER!' YOUR PRIMARY KENO GAME CONTROLS 'TOM'S KENO RACER' ! 'TOM'S KENO RACER' STARTS WITH YOUR NEXT PLAY OF THE PRIMARY KENO GAME. GOOD LUCK!"

As illustrated in FIG. 2M, since the first player is the designated player for the "Tom's Keno Racer" multiplayer secondary game in this example embodiment, the first EGM 1110 displays both the underlying primary keno game played by the first player and the "Tom's Keno Racer" multiplayer secondary game as an overlay atop or otherwise in association with the primary keno game.

For the play of the "Tom's Keno Racer" multiplayer secondary game, the server assigns each player of the "Tom's Keno Racer" multiplayer secondary game a different row of the keno board positions 201 to 280. For each player of the "Tom's Keno Racer" multiplayer secondary game, the first EGM 1110 displays an indicator (such as an avatar, a symbol, and the like) at the leftmost keno board position of the row of the keno board positions with which that player is associated. Specifically, in this example embodiment: (a) the server associates "Tom's Keno Racer" multiplayer secondary game player Jess with the row of the keno board positions 211 to 220 and the first EGM 1110 displays an indicator 402 in association with the keno board position 211, (b) the server associates "Tom's Keno Racer" multiplayer secondary game player Joe with the row of the keno board positions 231 to 240 and the first EGM 1110 displays an indicator 404 in association with the keno board position 231, (c) the server associates "Tom's Keno Racer" multiplayer secondary game player Tom with the row of the keno board positions 241 to 250 and the first EGM 1110 displays an indicator 406 in association with the keno board position 241, and (d) the server associates "Tom's Keno Racer" multiplayer secondary game player Mary with the row of the keno board positions 261 to 270 and the first EGM 1110 displays an indicator 408 in association with the keno board position 261.

The first EGM 1110 provides a play of the primary keno game. More specifically, as illustrated in FIG. 2M, upon initiation of the play of the primary keno game, the first EGM 1110 enables the player to select ten of the numbers to include in the player number set (such as by using a touch screen or a dedicated button or buttons, as described further below). The first EGM 1110 displays the following message in the message box 295: "SELECT UP TO TEN NUMBERS AND PRESS 'SUBMIT' TO CREATE YOUR PLAYER NUMBER SET."

As illustrated in FIG. 2N, the first EGM 1110 receives a selection of the following ten numbers and an actuation of the SUBMIT button 294 from the first player to form the player number set: 1, 19, 23, 33, 40, 44, 55, 64, 71, and 80. The numbers forming the player number set are each bolded and boxed for clarity. The first EGM 1110 displays the following message in the message box 295: "YOU SELECTED THE NUMBERS 1, 19, 23, 33, 40, 44, 55, 64, 71, AND 80 TO INCLUDE IN YOUR PLAYER NUMBER SET. PLEASE WAIT WHILE THE EGM SELECTS TWENTY NUMBERS TO INCLUDE IN THE EGM NUMBER SET . . . ."

As illustrated in FIG. 2O, the first EGM 1110 randomly selected the following twenty numbers to form the EGM number set: 2, 11, 16, 20, 21, 23, 27, 29, 31, 34, 36, 48, 52, 53, 55, 57, 62, 69, 70, and 76. The numbers forming the EGM number set are hashed for clarity. In this example embodiment, the first EGM 1110 determines any awards by comparing the player number set with the EGM number set to determine a quantity of matching numbers. In this example embodiment, the player number set and the EGM number set each include the following numbers: 23 and 55. Thus, the quantity of matching numbers for this play of the primary keno game is equal to two. The first EGM 1110 determines that no awards are associated with a quantity of two matching numbers. The first EGM 1110 displays the following message in the message box 295: "THE EGM SELECTED THE NUMBERS 2, 11, 16, 20, 21, 23, 27, 29, 31, 34, 36, 48, 52, 53, 55, 57, 62, 69, 70, AND 76 TO INCLUDE IN THE GAMING SYSTEM NUMBER SET. TWO NUMBERS IN YOUR PLAYER NUMBER SET MATCH NUMBERS IN THE EGM NUMBER SET. SORRY, YOU DIDN'T' WIN AN AWARD FOR MATCHING TWO NUMBERS."

With respect to the "Tom's Keno Racer" multiplayer secondary game, as explained above, for each of the indicators, the first EGM 1110 moves that indicator one keno board position to the right if the first EGM 1110 selects the number in the keno board position at which that indicator is displayed as one of the numbers to include in the EGM number set for the play of the primary keno game. In this example embodiment: (a) since the first EGM 1110 selected the number 11, which is the number in the keno board position 211 at which the indicator 402 is displayed, the first EGM 1110 moves the indicator 402 to the keno board position 212; (b) since the first EGM 1110 selected the number 31, which is the number in the keno board position 231 at which the indicator 404 is displayed, the first EGM 1110 moves the indicator 404 to the keno board position 232; (c) since the first EGM 1110 did not select the number 41, which is the number in the keno board position 241 at which the indicator 406 is displayed, the first EGM 1110 does not move the indicator 406; and (d) since the first EGM 1110 did not select the number 61, which is the number in the keno board position 261 at which the indicator 408 is displayed, the first EGM 1110 does not move the indicator 408.

FIG. 2P illustrates a screenshot of the second EGM 2110 when the second player actuates the VIEW YOUR PENDING SECONDARY GAME(S) button 602. Specifically, after receiving the actuation of the VIEW YOUR PENDING SECONDARY GAME(S) button 602, the second EGM 2110 displays a YOUR PENDING SECONDARY GAMES screen. The YOUR PENDING SECONDARY GAMES screen includes a representation 660 of the "Tom's Keno Racer" multiplayer secondary game and an ENLARGE button 660*a* that, when actuated by the second player, causes the second EGM 2110 to display a pop-up window 700 displaying a larger representation of the "Tom's Keno Racer" multiplayer secondary game, as shown in FIG. 2Q.

Variations

In various embodiments, if the designated player of a multiplayer secondary game (i.e., the player whose primary game play controls play of the multiplayer secondary game): (a) cashes out of the designated player's EGM, (b) logs out of the designated player's gaming application on the designated player's device, (c) has a credit balance that falls below a threshold amount (such as a minimum wager amount), (d) is idle for at least a designated time period, (e) has not initiated a play of the primary game for at least a designated time period, (f) plays the primary game at a rate below a minimum rate of primary game play, (g) quits the multiplayer secondary game, and/or (h) is playing the primary game on a device that malfunctions (e.g., freezes, experiences a power interruption, and the like), the gaming system: (1) sets one of the other players of the multiplayer secondary game as the designated player and continues play of the multiplayer secondary game; (2) pauses the multiplayer secondary game until the original designated player returns, at which point the gaming system continues the multiplayer secondary game; (3) prevents the designated player from creating and/or enrolling in any multiplayer secondary games for a designated time period; (4) ends the multiplayer secondary game and, for each remaining player, returns that player's secondary game wager to that player; (5) ends the multiplayer secondary game and, for each remaining player, returns that player's secondary game wager to that player and provides that player with a pro-rated portion (based on the number of remaining players) of the original designated player's secondary game wager; (6) replaces the designated player with a gaming system-controlled player and continues play of the multiplayer secondary game; (7) pauses the multiplayer secondary game and enables another player to join the multiplayer secondary game as the designated player; (8) adds each remaining player of the multiplayer secondary game to a different multiplayer secondary game (such as another pending multiplayer secondary game of the same type); and/or (9) enables the remaining players to "buy out" the designated player (i.e., the player who exited) to cause the gaming system to resume the multiplayer secondary game.

In certain embodiments, if a non-designated player of a multiplayer secondary game (i.e., the player whose primary game play does not control play of the multiplayer secondary game): (a) cashes out of the player's EGM, (b) logs out of the player's gaming application on the designated player's device, (c) quits the multiplayer secondary game, and/or (d) is playing the primary game on a device that malfunctions (e.g., freezes, experiences a power interruption, and the like), the gaming system: (1) pauses the multiplayer secondary game until the player returns, at which point the gaming system continues the multiplayer secondary game; (2) prevents that player from creating and/or enrolling in any multiplayer secondary games for a designated time period; (3) ends the multiplayer secondary game and, for each remaining player, returns that player's secondary game wager to that player; (4) ends the multiplayer secondary game and, for each remaining player, returns that player's secondary game wager to that player and provides that player with a pro-rated portion (based on the number of remaining players) of the original designated player's secondary game wager; (5) replaces the player with a gaming system-controlled player and continues play of the multiplayer secondary game; (6) pauses the multiplayer secondary game and enables another player to join the multiplayer secondary game to replace that player; (7) enables the remaining players to "buy out" that player (i.e., the player who exited) to cause the gaming system to resume the multiplayer secondary game; (8) continues play of the multiplayer secondary game; and/or (9) ends the multiplayer secondary game and, for each player including the player who exited, returns that player's secondary game wager to that player.

In certain embodiments, the gaming system enables a player of a multiplayer secondary game to quit the multiplayer secondary game at any point in time. In one such embodiment, the gaming system returns the player's secondary game wager to the player when the player quits the multiplayer secondary game. In another such embodiment, the gaming system forfeits (i.e., does not return) the player's secondary game wager to the player when the player quits the multiplayer secondary game.

In certain embodiments, the gaming system enables each player to customize that player's community panel and stores that player's customized community panel in association with that player, such as in association with player tracking information of that player. For instance, the gaming system enables each player to: (a) create a customized avatar that the gaming system may employ when displaying the multiplayer secondary game overlay on the device of the designated player during play of the multiplayer secondary game; (b) create shortcut buttons, such as buttons that enable one-touch or one-click creation of a particular multiplayer secondary game (such as a multiplayer secondary game having a particular set of attributes) and buttons that enable one-touch or one-click joining of a multiplayer secondary game (such as an already-created multiplayer secondary game satisfying a certain set of criteria).

As noted above, the gaming system enables the player to customize any suitable attributes when creating a multiplayer secondary game. In certain embodiments, the gaming system enables a player to enable gaming system-controlled players to participate in the multiplayer secondary game. In one such embodiment, the gaming system enables the player to affirmatively choose to include one or more gaming system-controlled players to participate in the multiplayer secondary game. In another such embodiment, the gaming system enables the player to choose to enable the gaming system to automatically include up to a certain quantity of gaming system-controlled players as participants in the multiplayer secondary game in the event that enough human players do not enroll in the multiplayer secondary game. For instance, in one example embodiment, the gaming system enables the player to choose to enable the gaming system to automatically fill any remaining spots for a multiplayer secondary game with gaming system-controlled players after a designated time period elapses.

In various embodiments, the gaming system creates one or more multiplayer secondary games and enables players to enroll in and participate in those multiplayer secondary games.

In certain embodiments, the gaming system includes one or more generic multiplayer secondary games that are each supported by any primary game. That is, in these embodiments, the gaming system does not require a player to be playing a particular type of primary game to create one of the generic multiplayer secondary games.

In various embodiments, the gaming system includes one or more multiplayer secondary games that are each supported by any suitable primary game of a particular type. That is, in these embodiments, the gaming system requires a player to be playing a primary game of a particular type to create a multiplayer secondary game associated with that type of game. For instance, in one example embodiment, the gaming system includes a multiplayer secondary game supported by any type of card game. Thus, in this example embodiment, the gaming system requires a player to be playing any type of card game (e.g., a draw poker game, a Pai Gow poker game, a blackjack game, a war game, and the like) to create that multiplayer secondary game.

In certain embodiments, the gaming system enables a player to create any multiplayer secondary game, regardless of which primary game the player is playing. In one such embodiment, if the designated player is not playing the appropriate primary game when the gaming system initiates the multiplayer secondary game, the gaming system requires the designated player to begin playing the appropriate primary game. In another such embodiment, if the designated player is not playing the appropriate primary game when the gaming system initiates the multiplayer secondary game, the gaming system selects a different player who is playing the appropriate primary game as the designated player. In another such embodiment, if the designated player is not playing the appropriate primary game when the gaming system initiates the multiplayer secondary game, the gaming system creates and employs a gaming system-controlled designated player for the play of the multiplayer secondary game.

In various embodiments, certain of the multiplayer secondary games include interim goals that, when reached by a player of the multiplayer secondary game, cause the gaming system to provide an interim award to that player. For instance, in a variation of the slot multiplayer secondary game described above, the slot multiplayer secondary game includes: (a) an interim goal of achieving a designated combination of player-associated symbols, and (b) a final goal of achieving 100 player-associated symbols. These interim goals and associated interim awards keep players interested throughout the entire play of the multiplayer secondary game.

It should be appreciated that, for a given multiplayer secondary game, the gaming system provides player tracking points (or any other suitable player loyalty points) while the designated player is playing the primary game that controls play of the multiplayer secondary game. In certain embodiments, the gaming system provides a certain percentage (which may be any suitable percentage) of the player tracking points earned by the designated player during plays of the primary game that control play of the multiplayer secondary game to the other players of the secondary game. For instance, if the designated player earns 250 player tracking points during play of the primary game while the multiplayer secondary game is in play, the gaming system provides 25 player tracking points (or 10% of that earned quantity) to each of the other players of the multiplayer secondary game. This incentivizes players to join as many multiplayer secondary games as possible to dramatically increase their rate of earning player tracking points.

In certain embodiments, the gaming system enables each player to enroll in only one multiplayer secondary game at any given point in time. In other embodiments, the gaming system enables each player to enroll in up to a designated quantity of multiplayer secondary games at any given point in time. In further embodiments, the gaming system does not limit the number of multiplayer secondary games in which each player may enroll.

In various embodiments, players may enroll in a multiplayer secondary game using the same device. For example, the maximum quantity of four players may enroll in a slot multiplayer secondary game using a single EGM, and the designated player may then play the associated primary slot game at that same EGM, which controls play of the slot multiplayer secondary game, while the remaining three players watch.

In certain embodiments, the gaming system does not require a player to have a player tracking account or a player tracking card to enroll in and participate in a multiplayer secondary game. In these embodiments, the gaming system enables the player to otherwise identify herself (such as by a unique username combined with a personal identification number (PIN)) when enrolling in a multiplayer secondary game. In one such embodiment, the gaming system requires such a player to enroll in the multiplayer secondary game using the device of the designated player, while in another embodiment the gaming system has no such requirement. In one embodiment, regardless of the device that such a player employs to enroll in the multiplayer secondary game, the player obtains any awards for the multiplayer secondary game from the device of the designated player.

In various embodiments, the gaming system enables a player of a multiplayer secondary game to obtain any awards won during the multiplayer secondary game at a kiosk or cashier instead of at the player's device.

In certain embodiments, when a player is enrolled in an ongoing multiplayer secondary game and the player's community panel window is closed, the player's device automatically opens the community panel window whenever the multiplayer secondary game progresses. In other embodiments, when a player is enrolled in an ongoing multiplayer secondary game and the player's community panel window is closed, the player's device automatically opens the community panel window whenever the multiplayer secondary game progresses with respect to that particular player. In further embodiments, when a player is enrolled in an ongoing multiplayer secondary game and the player's community panel window is closed, the player's device displays a pop-up window informing the player whenever the multiplayer secondary game progresses. In other embodiments, when a player is enrolled in an ongoing multiplayer secondary game and the player's community panel window is closed, the player's device displays a pop-up window informing the player whenever the multiplayer secondary game progresses with respect to that particular player.

In various embodiments, one or more of the multiplayer secondary games have qualification criteria that a player must satisfy before the gaming system enables the player to create and/or join that multiplayer secondary game. For instance, in one example embodiment, the gaming system enables a player to join a particular multiplayer secondary game only if the player's player loyalty ranking exceeds a designated ranking. In another example embodiment, the gaming system enables the player to join a particular multiplayer secondary game only if the player's average wager over a designated period of time exceeds a threshold amount. In another example embodiment, the gaming system enables the player to join a particular multiplayer secondary game only if the player's average rate of play over a designated period of time exceeds a threshold rate. In another example embodiment, the gaming system enables the player to join a particular multiplayer secondary game only if the denomination at which the player is playing the player's primary game exceeds a designated amount.

It should be appreciated that the gaming system may display the secondary game window in any suitable manner, such as (but not limited to): (a) on the primary display device of a device, (b) on a secondary display device of the device (such as a top box or a player tracking display), (c) in a service window of the device, (d) on a separate device (such as the player's smartphone or tablet computing device), and/or (e) on a device of one or more persons who are not enrolled in the multiplayer secondary game (such as spectators in a gaming establishment, spectators logged into an online casino, or casino personnel).

It should be appreciated that the present disclosure contemplates players being able to enroll in and participate in one or more multiplayer secondary games via an online casino. In certain such embodiments, the gaming system enables players playing on EGMs at a brick-and-mortar gaming establishment and players playing at an online casino using their personal devices to enroll in and participate in the same multiplayer secondary game. In other such embodiments, the gaming system enables: (a) players playing on EGMs at a brick-and-mortar gaming establishment (and not players of an online casino) to enroll in and participate in the same multiplayer secondary game, and (b) players playing at an online casino using their personal devices (and not players playing on EGMs at a brick-and-mortar gaming establishment) to enroll in and participate in the same multiplayer secondary game It should be appreciated that any of the variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
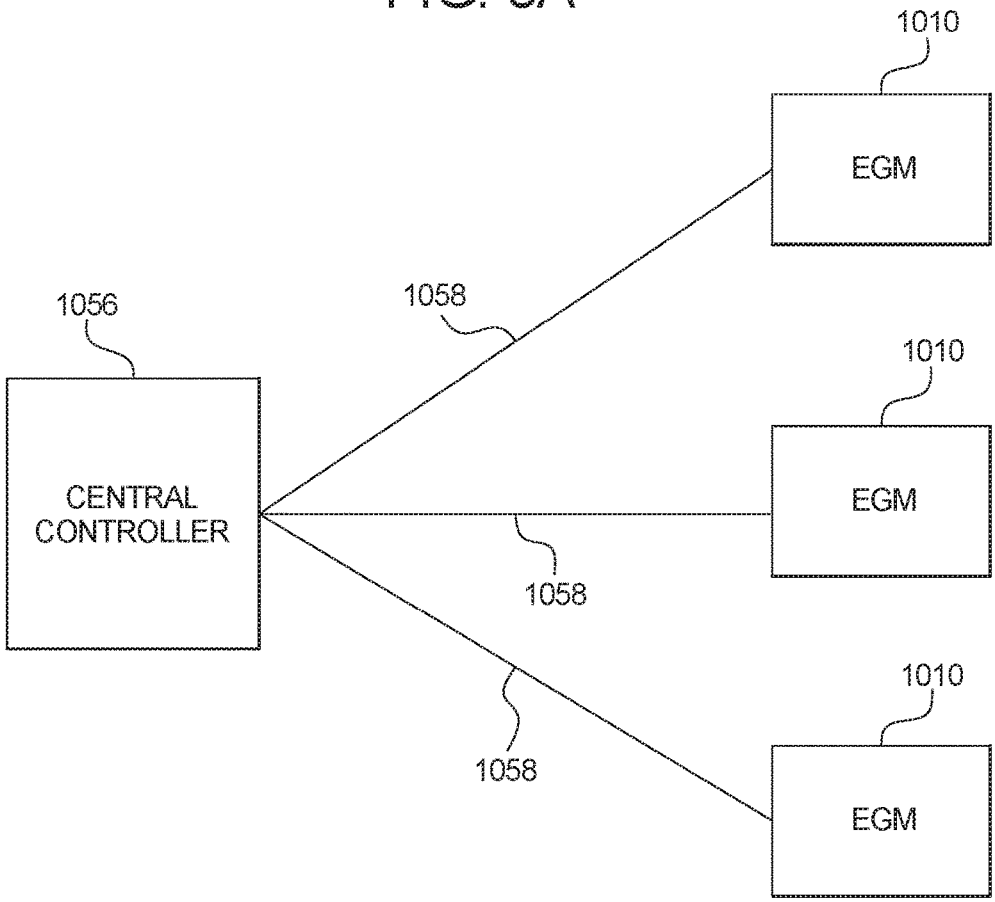
FIG. 3A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
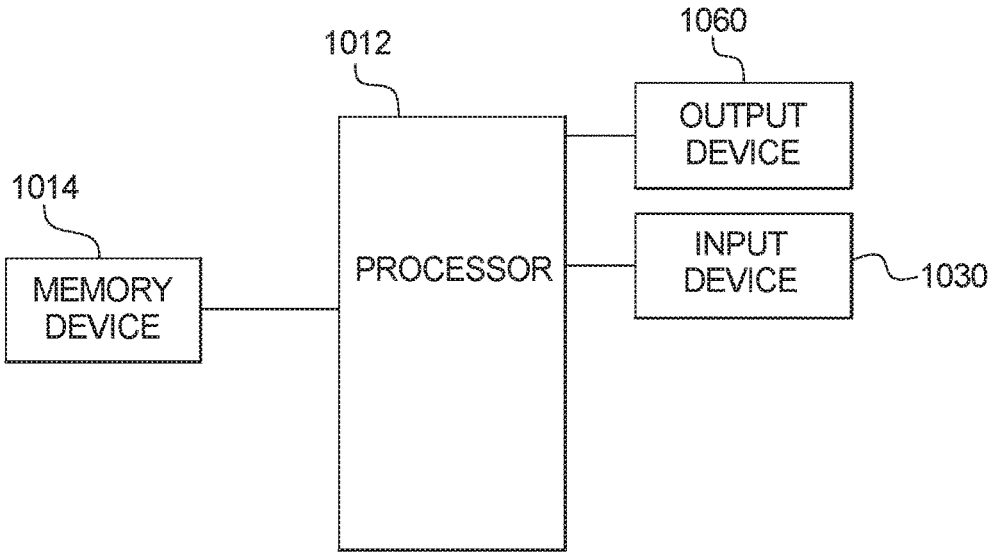
FIG. 3B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
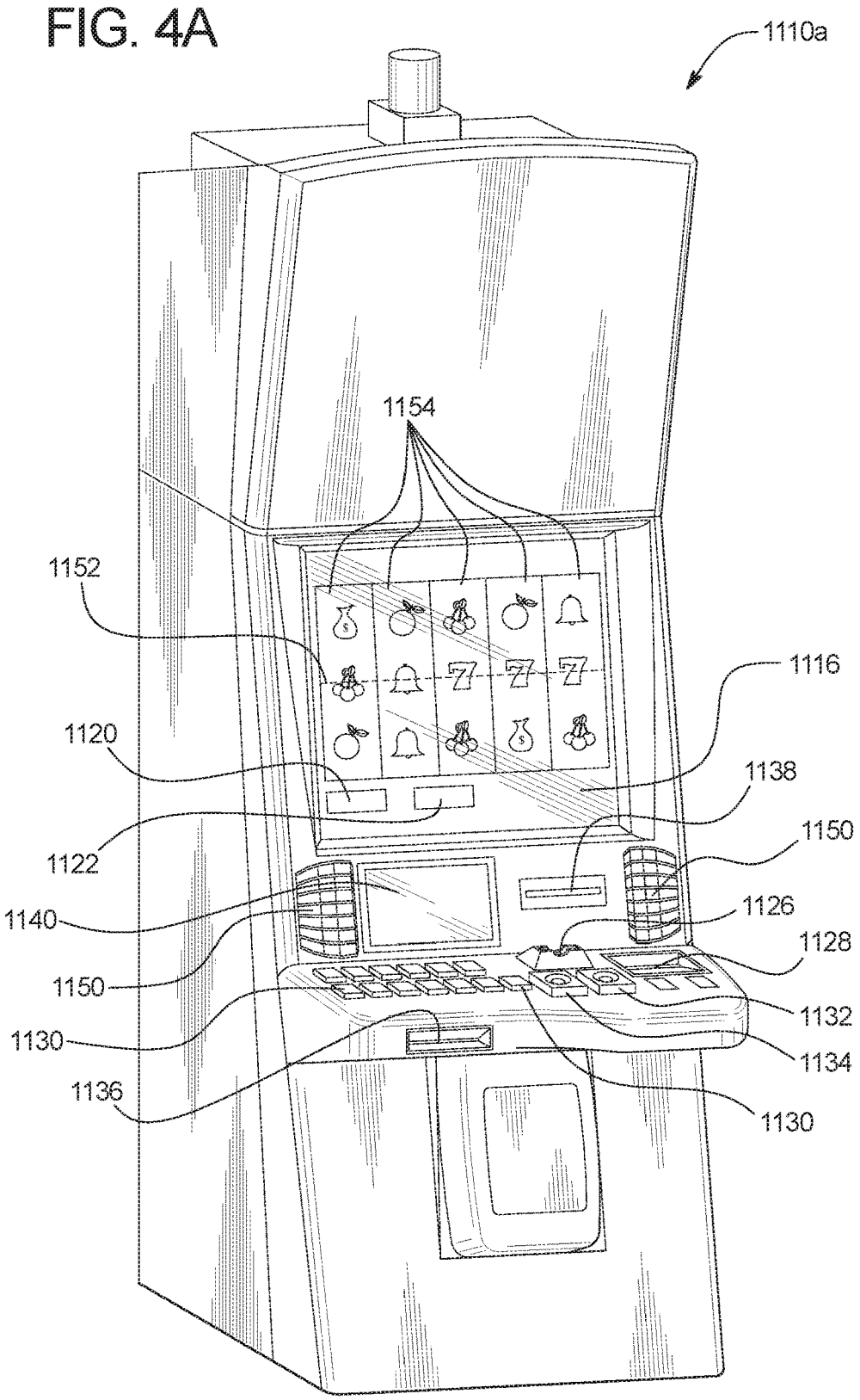
FIGS. 4A and 4B are perspective views of example alternative embodiments of the gaming system of the present disclosure.
Figure 4B:
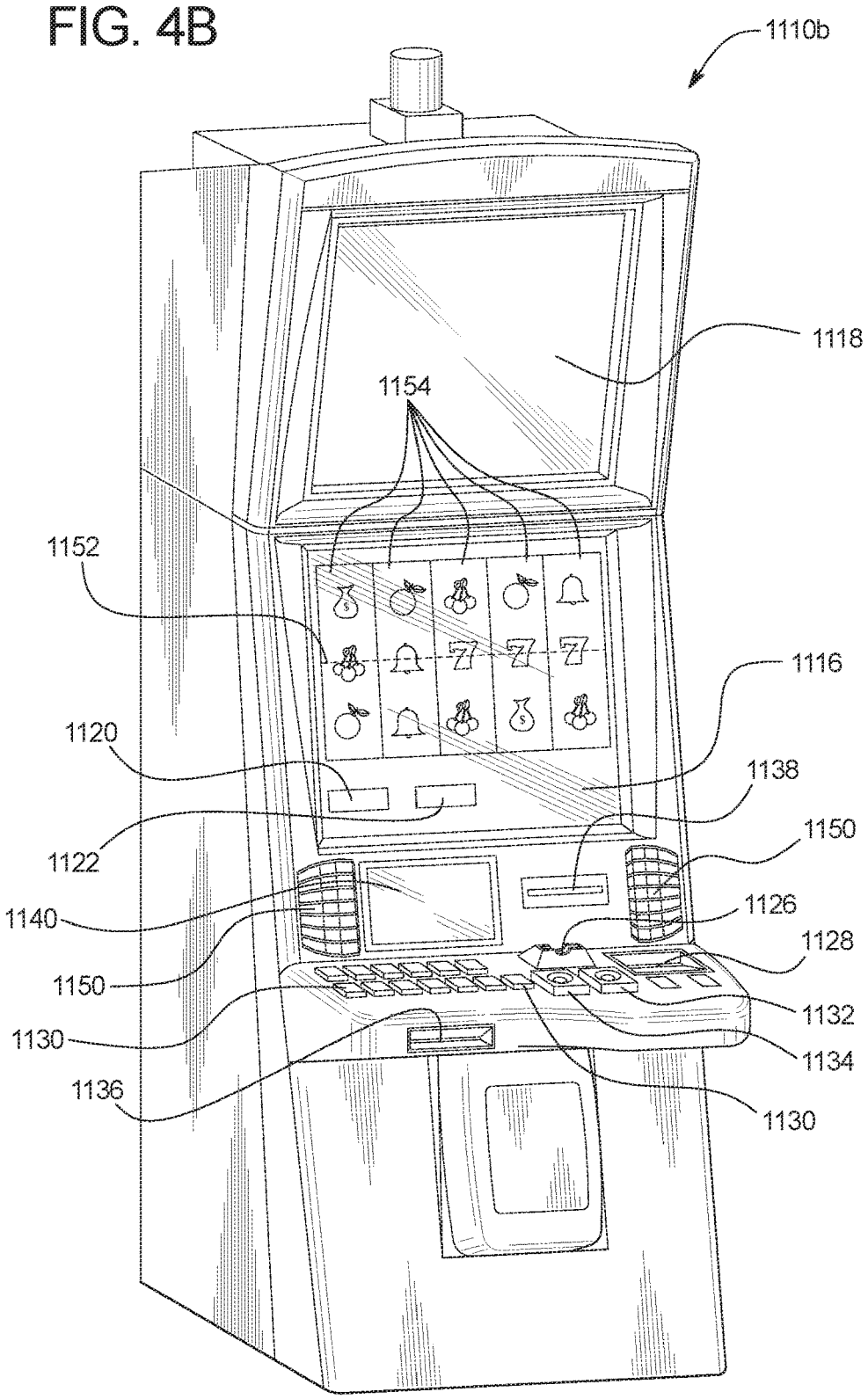

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:
an input device;
a display device;
a processor; and
a memory device that stores a plurality of instructions which, when executed by the processor, cause the processor to:
responsive to receipt, via the input device, of an input by a first player to play a primary game:
determine a primary game outcome,
cause the display device to display the determined primary game outcome,
determine an award associated with the determined primary game outcome, and
cause the display device to display the determined award associated with the determined primary game outcome, and
responsive to a triggering of a play of a multiplayer secondary game:
determine a multiplayer secondary game outcome for a plurality of players, wherein the plurality of players includes the first player and a second player associated with a different device, the determined multiplayer secondary game outcome is based on the determined primary game outcome and the determined multiplayer secondary game outcome is independent of any primary game outcomes determined for any plays of any primary games by any of the second players,
cause the display device to display the determined multiplayer secondary game outcome,
determine an award associated with the determined multiplayer secondary game outcome, and
cause the display device to display the determined award associated with the determined multiplayer secondary game outcome.

2. The gaming system of claim 1, wherein when executed by the processor, the instructions cause the processor to enable the first player to create the multiplayer secondary game.

3. The gaming system of claim 2, wherein when executed by the processor, the instructions cause the processor to enable the first player to customize at least one feature of the multiplayer secondary game.

4. The gaming system of claim 1, wherein a frequency of triggering the play of the multiplayer secondary game is based on a pace of the play of the primary game by the first player.

5. The gaming system of claim 1, wherein a frequency of triggering the play of the multiplayer secondary game is based on a progress of the play of the primary game by the first player.

6. The gaming system of claim 1, further comprising an acceptor, wherein when executed by the processor, the plurality of instructions cause the processor to, responsive to a physical item being received via the acceptor, modify a credit balance based on a monetary value associated with the received physical item, and responsive to a cashout input being received, cause an initiation of any payout associated with the credit balance.

7. The gaming system of claim 1, wherein the display device comprises part of a mobile device in communication with the processor via a wireless network.

8. A gaming system comprising:
an input device;
a display device;
a processor; and
a memory device that stores a plurality of instructions which, when executed by the processor, cause the processor to:
responsive to receipt, via the input device, of an input by a first player to play a first primary game:
determine a first primary game outcome,
cause the display device to display the determined first primary game outcome,
determine an award associated with the determined first primary game outcome, and
cause the display device to display the determined award associated with the determined first primary game outcome, and
responsive to a triggering of a play of a multiplayer secondary game:
determine a multiplayer secondary game outcome for a plurality of players, wherein the plurality of players includes the first player and a second player associated with a different device, the determined multiplayer secondary game outcome is based on a determined second primary game outcome of a play of a second primary game by the second player, and the determined multiplayer secondary game outcome is independent of the determined first primary game outcome, cause the display device to display the determined multiplayer secondary game outcome, determine an award associated with the determined multiplayer secondary game outcome, and cause the display device to display the determined award associated with the determined multiplayer secondary game outcome.

9. The gaming system of claim 8, wherein when executed by the processor, the instructions cause the processor to enable the first player to enroll in the multiplayer secondary game.

10. The gaming system of claim 8, wherein the triggering of the play of the multiplayer secondary game occurs after a designated quantity of players have enrolled in the multiplayer secondary game.

11. The gaming system of claim 8, wherein a frequency of triggering the play of the multiplayer secondary game is based on a pace of the play of the second primary game by the second player.

12. The gaming system of claim 8, wherein a frequency of triggering the play of the multiplayer secondary game is based on a progress of the play of the second primary game by the second player.

13. The gaming system of claim 8, further comprising an acceptor, wherein when executed by the processor, the plurality of instructions cause the processor to, responsive to a physical item being received via the acceptor, modify a credit balance based on a monetary value associated with the received physical item, and responsive to a cashout input being received, cause an initiation of any payout associated with the credit balance.

14. The gaming system of claim 8, wherein the display device comprises part of a mobile device in communication with the processor via a wireless network.

15. A gaming system comprising:

a processor; and a memory device that stores a plurality of instructions which, when executed by the processor, cause the processor to:

responsive to a triggering of a play of a multiplayer secondary game:

determine a multiplayer secondary game outcome for a plurality of players associated with a plurality of devices, wherein the plurality of players includes a first player and a second player, the determined multiplayer secondary game outcome is based on a determined first primary game outcome of a play of a first primary game by the first player, and the determined multiplayer secondary game outcome is independent of any primary game outcomes determined for any plays of any primary games by any of the second players, communicate data to each of the plurality of devices which results in each of the plurality of devices displaying the determined multiplayer secondary game outcome, determine an award associated with the determined multiplayer secondary game outcome, and communicate data to each of the plurality of devices which results in each of the plurality of devices displaying the determined award associated with the determined multiplayer secondary game outcome.

16. The gaming system of claim 15, wherein when executed by the processor, the instructions cause the processor to enable the first player to create the multiplayer secondary game.

17. The gaming system of claim 16, wherein when executed by the processor, the instructions cause the processor to enable the first player to customize at least one feature of the multiplayer secondary game.

18. The gaming system of claim 15, wherein when executed by the processor, the instructions cause the processor to enable the second player to enroll in the multiplayer secondary game.

19. The gaming system of claim 15, wherein a frequency of triggering the play of the multiplayer secondary game is based on a pace of the play of the first primary game by the first player.

20. The gaming system of claim 15, wherein a frequency of triggering the play of the multiplayer secondary game is based on a progress of the play of the first primary game by the first player.

* * * * *